US005637070A

United States Patent [19]

Sasai

[11] Patent Number: 5,637,070

[45] Date of Patent: Jun. 10, 1997

[54] CURL CORRECTING DEVICE

[75] Inventor: Keizo Sasai, Yokohama, Japan

[73] Assignee: Canon Kabushiki Kaisha, Tokyo, Japan

[21] Appl. No.: 464,476

[22] Filed: Jun. 5, 1995

Related U.S. Application Data

[63] Continuation of Ser. No. 351,037, Nov. 28, 1994, abandoned, which is a continuation of Ser. No. 268,668, Jun. 30, 1994, abandoned, which is a continuation of Ser. No. 180,475, Jan. 12, 1994, abandoned, which is a continuation of Ser. No. 926,187, Aug. 7, 1992, abandoned, which is a continuation of Ser. No. 557,079, Jul. 25, 1990, abandoned.

[30] Foreign Application Priority Data

| | | | |
|---|---|---|---|
| Jul. 27, 1989 | [JP] | Japan | 1-192631 |
| Jul. 27, 1989 | [JP] | Japan | 1-192632 |
| Jul. 27, 1989 | [JP] | Japan | 1-192634 |
| Jul. 27, 1989 | [JP] | Japan | 1-192636 |
| Jul. 27, 1989 | [JP] | Japan | 1-192637 |
| Jul. 27, 1989 | [JP] | Japan | 1-192640 |
| Jul. 27, 1989 | [JP] | Japan | 1-192641 |
| Jul. 27, 1989 | [JP] | Japan | 1-192642 |

[51] Int. Cl.[6] ..... B41F 25/00; B65H 23/34

[52] U.S. Cl. ..... 493/321; 493/459; 162/271

[58] Field of Search ..... 493/320, 321, 493/395, 459, 460, 465; 162/199, 270, 271

[56] References Cited

U.S. PATENT DOCUMENTS

| | | | |
|---|---|---|---|
| 1,296,191 | 3/1919 | Ireland . | |
| 3,389,401 | 6/1968 | Neff | 346/76 |
| 3,552,668 | 1/1971 | Kanno | 162/271 X |
| 3,567,143 | 3/1971 | Hesse | 242/55 |
| 3,593,833 | 7/1971 | Bretti | 197/132 |
| 3,649,447 | 3/1972 | Turner | 162/271 |
| 3,661,703 | 5/1972 | Shelor | 162/271 |
| 3,996,842 | 12/1976 | Ehlich et al. | 162/271 X |
| 4,165,029 | 8/1979 | Mitchell | 226/25 |
| 4,223,325 | 9/1980 | Ebert | 346/145 |
| 4,360,356 | 11/1982 | Hall | 162/271 X |
| 4,539,072 | 9/1985 | Frye et al. | 162/271 X |
| 4,849,824 | 7/1989 | Sakuragi et al. . | |
| 4,860,031 | 8/1989 | Lejeck | 346/136 |
| 4,868,674 | 9/1989 | Nakamura et al. . | |
| 4,952,281 | 8/1990 | Akira | 162/271 X |

FOREIGN PATENT DOCUMENTS

| | | |
|---|---|---|
| 662448 | 4/1963 | Canada . |
| 0372478 | 6/1990 | European Pat. Off. . |
| 0374827 | 6/1990 | European Pat. Off. . |
| 1804090 | 5/1969 | Germany . |
| 62-175377 | 8/1977 | Japan . |
| 59-59483 | 4/1984 | Japan . |
| 61-8369 | 1/1986 | Japan . |
| 61-68277 | 4/1986 | Japan . |

(List continued on next page.)

OTHER PUBLICATIONS

Official Search Report for Eur. Pat. Appln. 89122387.7 "Roll Feed Blousing Ball", Kotasek, T.J., IBM Technical Disclosure Bulletin, vol. 24, No. 11B (Apr., 1982).

Eur. Pat. Off. Search Report for Eur. Pat. App. No. 90114381.8, Jan. 13, 1992.

*Primary Examiner*—Jack W. Lavinder
*Assistant Examiner*—Christopher W. Day
*Attorney, Agent, or Firm*—Fitzpatrick, Cella, Harper & Scinto

[57] ABSTRACT

This invention relates to a curl correcting device comprising a sheet transport path, an opening member openable from a main body of the device, for opening the sheet transport path, transport means for transporting a sheet along the sheet transport path, a first guide member for guiding the sheet transported by the sheet transport means, a second guide member for guiding the sheet transported by the sheet transport means and correcting the curl of the sheet in cooperation with the first guide member, and moving means for moving at least one of the first and second guide members to a position not correcting the curl tendency, in a state in which the opening member is closed.

54 Claims, 35 Drawing Sheets

FOREIGN PATENT DOCUMENTS

| | | |
|---|---|---|
| 61-75764 | 4/1986 | Japan . |
| 61-163883 | 7/1986 | Japan . |
| 62-175377 | 8/1987 | Japan . |
| 63-27365 | 2/1988 | Japan . |
| 63-74862 | 4/1988 | Japan . |
| 0267253 | 10/1989 | Japan . |
| 2171082 | 8/1986 | United Kingdom . |

ℓ = 35mm
P = 150g
r = 13mm
T = 200gcm

ℓ = 50mm
P = 200g
r = 20mm
T = 400gcm

ℓ = 65mm
P = 250g
r = 4mm
T = 100gcm

CURL CORRECTING DEVICE

This application is a continuation of application Ser. No. 08/351,037 filed Nov. 28, 1994, now abandoned, which is a continuation of application Ser. No. 08/268,668 filed Jun. 30, 1994, now abandoned, which is a continuation of application Ser. No. 08/180,475 filed Jan. 12, 1994, now abandoned, which is a continuation of application Ser. No. 07/926,187 filed Aug. 7, 1992, now abandoned, which is a continuation of application Ser. No. 07/557,079 filed Jul. 25, 1990, now abandoned.

BACKGROUND OF THE INVENTION

1. Field of the Invention

The present invention relates to a curl correcting or decurling device for correcting the curl of a rolled sheet member.

2. Related Background Art

Presently popular office equipment such as facsimile apparatus and printers generally employ a long recording sheet rolled on a core in their recording system.

Because of the rolled state, such a sheet tends to show curling, and such a curled sheet often ends in jamming up the transportation. Therefore, for the purpose of eliminating or reducing such curl, a curl correcting mechanism is often employed in the recording apparatus utilizing such rolled sheets.

FIG. 29 shows an example of such a curl correcting mechanism, in which, in a main body 51 and a cover member 52 openably linked with a pin 53, a roll holder 54, a platen roller 55 and a cutter 56 are provided in the main body 51 while a curl correcting shaft 57 constituting the curl correcting mechanism and a recording head 58 are fixed on the cover member 52.

In the above-explained mechanism, a roll 59*a* of a sheet material 59 is loaded in the roll holder 54, and the sheet material 59 is advanced through the shaft 57 by the rotation of the platen roller 55, subjected to image formation by the recording head 58 and discharged from the mechanism after cutting by the cutter 56.

In this mechanism, the curl is reduced by bending the sheet material 59 by the curl correcting shaft 57 in a direction opposite to that of curling. In such a mechanism, the curl correcting effect is known to become larger as the wrapping angle α, shown in FIG. 30, of the sheet material 59 on the curl correcting shaft 57 becomes larger.

In the curl correcting mechanism shown in FIG. 29, the diameter of the sheet roll 59*a* decreases as the sheet material 59 is used, whereby the wrapping angle of the sheet material 59 on the shaft 57 gradually decreases from $\alpha_1$ to $\alpha_2$. Consequently, the curl correcting effect on the sheet material 59 decreases gradually, and satisfactory curl correction is often not achieved when the diameter of the sheet roll 59*a* is small where the curling tendency is stronger. FIG. 31 shows another curl correcting mechanism further having a guide shaft 60 for maintaining a constant wrapping angle α of the sheet material 59 on the curl correcting shaft 57. The platen roller 55 and the guide shaft 60 are mounted in the main body 51 while the shaft 57 and the recording head 58 are mounted on the cover member In this mechanism, the shaft 57 and the recording head 58 are rotated upwards together with the cover member 52 about the pin 53 to open the upper face of the main body 51 as shown by chain lines, whereby the loading of the sheet material 59 into the main body 51 is facilitated.

In the curl correcting mechanism shown in FIG. 31, the guide shaft 60 of the main body cannot be positioned above the shaft 57, as the shaft 57 rotates together with the cover member 52. For this reason, the wrapping angle α of the sheet material 59 on the shaft 57 can only be increased up to about 90°, so that a satisfactory curl correcting effect cannot be obtained.

For increasing the curl correcting effect, the wrapping angle α has to be further increased, for example by positioning the guide shaft 60 in the rotating direction of the curl correcting shaft 57 as shown in FIG. 32A, but, in such an arrangement, the cover member 52 cannot be rotated upwards at the loading of the sheet material 59 into the main body 51 as the shaft 57 interferes with the guide shaft 60.

For this reason the shaft 57 and the guide shaft 60 have to be mounted in the main body 51. However, at the loading of the sheet material 59, it then becomes necessary to thread the leading end of the sheet material 59 between the shafts 57 and 60 and pass it around the shaft 57, so that the loading operation becomes cumbersome.

Also for mounting the shaft 57 on the cover member 52 and still obtaining a large wrapping angle α of the sheet material 59 on the shaft 57, it is necessary to position the shaft 57 quite some distance from the platen roller 55 and the guide shaft 60 as shown in FIG. 32B, but such an arrangement requires a significantly extended sheet path, resulting in frequent sheet jamming.

FIG. 33 shows another curl correcting mechanism, in which, in a main body 81 and a cover member 82 openably linked with a pin 83, a roller holder 84, a platen roller 85, a cutter 86 and a guide member 87*a* constituting the curl correcting mechanism are mounted in the main body 81 while a recording head 88, and a guide member 87*b* constituting the curl correcting mechanism in cooperation with said guide member 87*a* are mounted on the cover member 82.

In this mechanism, sheet material 89, formed as a roll 89*a*, is advanced by the rotation of the platen roller 85, subjected to the recording head 88 and discharged from the mechanism after cutting by the cutter 86. The curl of the sheet material 89 is reduced when it passes a bent path formed by the guide members 87*a*, 87*b* and is bent in a direction opposite to that of curling.

Furthermore there has been proposed another curl correcting mechanism as shown in FIG. 34. In this mechanism, arms 91, rotatably mounted on both ends of a guide shaft 90, rotatably supports a curl correcting shaft 92 at their free ends. Said arms 91 are constantly biased counterclockwise by a spring but the driven clockwise through a friction clutch (not shown) when the platen roller 85 is rotated in a direction indicated by the arrow. Stoppers 93, 94 are provided in predetermined positions of the main body 81 for limiting the rotation of the arms 91.

In the above-explained mechanism, the sheet material 89 is advanced by the rotation of the platen roller 85 in the direction indicated by the arrow. At the same time, the arms 91 rotate clockwise but are stopped by contact with the stopper 94 whereupon the friction clutch starts to slip. Thus the advancing sheet material 89 is guided through the guide shaft 90 from the roll 89*a* and is bent by the shaft 92 in a direction opposite to that of the curl, whereby the curl is reduced.

When the rotation of the platen roller 85 is terminated, the arms 91 return to the stand-by position in contact with the stopper 93, by the biasing force of the spring.

The curling of the sheet material 89 depends not only on the roller diameter but also on other factors such as the thickness and kind of the sheet material 89, and the time that has passed since the sheet is rolled. For example, thermal paper has a thickness of about 65 μm while plain paper used for ink transfer recording has a thickness of about 85 μm, so that the plain paper tends to show stronger curling for a given roll diameter.

However, in the curl correcting mechanism shown in FIG. 33, the bending angle defined by the curl correcting guide members 87*a*, 87*b* is constant.

Also in the curl correcting mechanism shown in FIG. 34, the curl correcting effect determined by the position of the arms 91 or curl correcting shaft 92 is kept constant by the stopper 94.

Consequently, if the bending angle defined by the guide members 87*a*, 87*b* or the position of the stopper 94 is designed to correct curl in a thermal recording sheet, the curl correcting effect becomes insufficient for the plain recording sheet. On the other hand, if the curl correcting conditions are determined for the plain recording paper, an excessive correcting effect will appear for the thermal recording sheet, which will therefore be curled in the opposite direction. In either case there will be defective sheet transportation, leading eventually to sheet jamming.

For example, the recording unit of a facsimile apparatus is designed to use both thermal recording paper and plain recording paper, and appropriate curl correction cannot be attained depending on the thickness or the kind of the sheet material 89, if the curl correcting effect is fixed as it is in the devices shown in FIGS. 33 or 34.

SUMMARY OF THE INVENTION

An object of the present invention is to provide a curl correcting mechanism free from the above-mentioned drawbacks found in the prior art, which is capable of effective curl correction, and providing a simple structure in the sheet convey path and enabling an easy loading operation of the sheet material, and a recording apparatus provided with this curl correcting mechanism.

Another object of the present invention is to provide a curl correcting mechanism in which a guide member is mounted on a cover openable relative to a main body of the device (for opening a sheet convey path), and another guide member is mounted on the main body, so that the second guide member cooperates with the first guide member in correcting a curl of a sheet conveyed along the sheet convey path; and in which a lock and a lock release respectively hold the cover in a closed position and release the cover, and the relative position of the guide members is changed in a direction to weaken the curl correction when the lock is released.

Still another object of the present invention is to provide a curl correcting mechanism capable of effective curl correction without applying an unnecessary load on the transport means for sheet material, and enabling miniaturization of the mechanism, and a recording apparatus equipped with this curl correcting mechanism.

DETAILED DESCRIPTION OF THE PREFERRED EMBODIMENTS

In the following there will be explained a first embodiment of the present invention, with reference to FIG. 1 which is a perspective view of a recording system of a facsimile apparatus and FIG. 2 which is a cross-sectional view of the facsimile apparatus.

Figure 2:
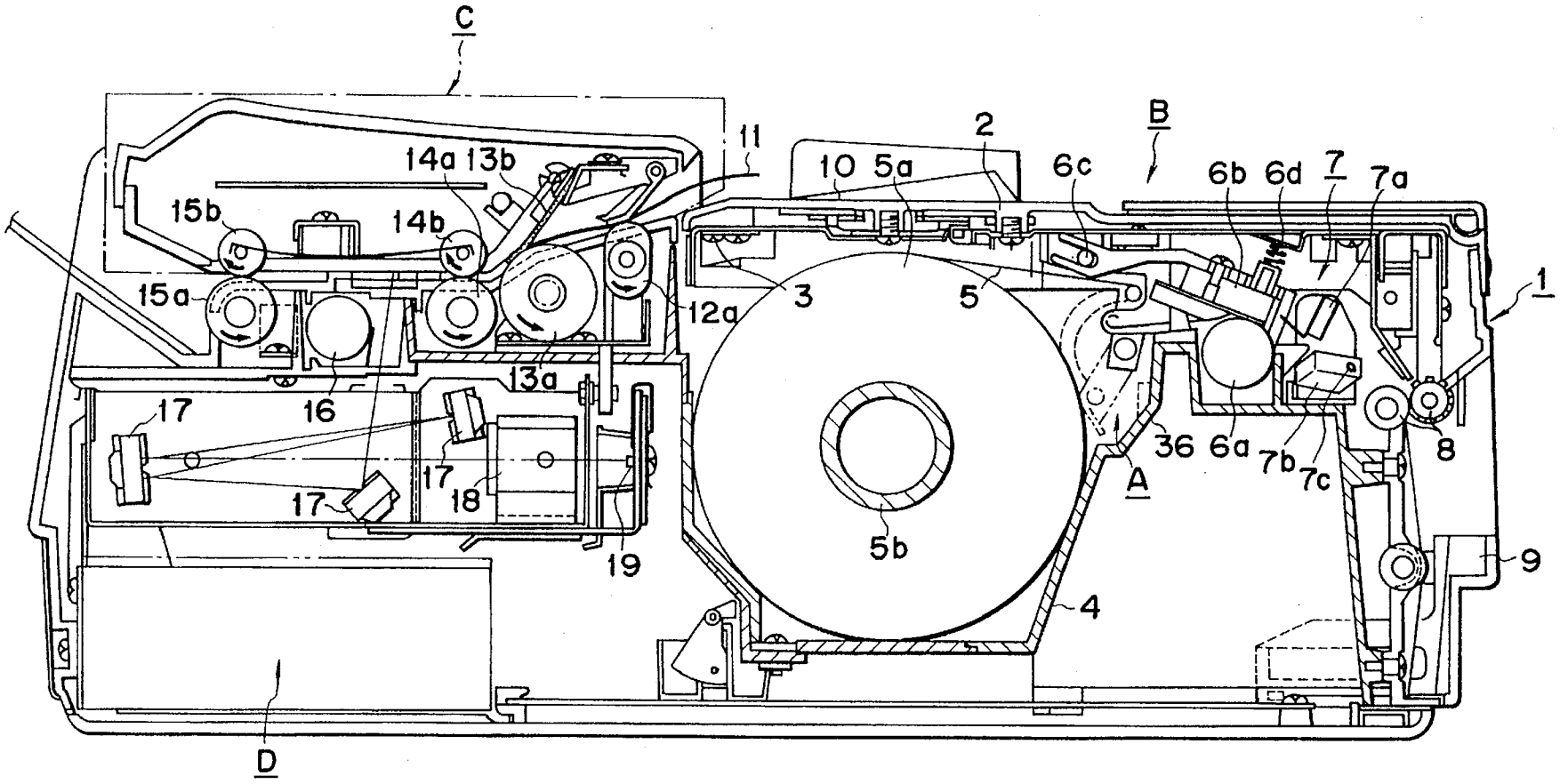
FIG. 2 is a cross-sectional view of a facsimile apparatus.

As shown in FIG. 2, the facsimile apparatus is composed of a recording unit B including a curl correcting device A, and an original reading unit C.

At first the entire structure will be briefly explained with reference to FIG. 2. The recording unit B has a cover member 2 which is hinged by a shaft 3 to the main body 1 of the apparatus and can be engaged with the main body 1 by an engaging mechanism to be explained later. In a predetermined position of the main body 1 there is provided a roll holder 4 in which there is loaded a roll 5*a* of a thermal recording sheet 5. The sheet material 5 is transported by the rotation of a platen roller 6*a* constituting transport means, and is subjected to curl correction by being bent in a direction opposite to that of curl in passing the curl correcting device A.

After the curl correction, the sheet 5 is subjected to image formation by recording means 6, then cut by a cutter 7 and discharged by discharge rollers 8 onto a discharged sheet stacker 9.

In the original reading unit C, plural original sheets 11 are sent on an original stacker 10 formed on the upper face of cover member 2. In the original reading operation, several originals at the bottom of the stack are advanced by a preliminary transport roller 12*a* and a pressure member 12*b*, and the lowermost one is separated and advanced by a separating roller 13*a* and a pressure member 13*b* cooperating therewith. The separated original 11 is illuminated by a light source 16 while being transported by paired transport rollers 14*a*, 14*b* and 15*a*, 15*b*, and the reflected light is guided through mirrors 17 and a lens 18 to a photoelectric converting element 19 such as a CCD for conversion into an electrical signal. This signal is transmitted to the recording unit B of the same apparatus the case of copy mode, or of another apparatus the case of facsimile mode. Below the original reading unit C there is provided a power supply unit D.

In the following, there will be explained the structure of the recording unit B equipped with the curl correcting mechanism A.

The roll holder 4, open at the upper side, is positioned at the far side in the main body 1 of the recording unit. The sheet roll 5*a* is loaded in roll holder 4, and a friction force is generated by the contact between the external periphery of roll 5*a* and the internal face of the roll holder 4. The friction force is large when the roll 5*a* is large in diameter and heavy, but decreases as the roll 5*a* decreases in weight because of and use of the sheet 5. The friction resistance applies tension to the dragged sheet 5, and this tension varies in proportion to said friction resistance.

The recording means 6 for image recording on sheet 5 is composed of a platen roller 6*a* and a recording head 6*b*. The platen roller 6*a* is formed by a roller-shaped member with a high friction coefficient such as hard rubber and is rotatably mounted in the main body 1 for driving by a motor 20. As shown in FIG. 1, the motor 20 rotates the platen roller 6*a* through a gear 21*a* fixed on the motor shaft, an intermediate gear 21*b* and a gear 21*c* fixed on the shaft of the platen roller 6*a*. The platen roller 6*a* functions also as transport means for advancing the sheet 5.

The recording head 6*b* forms an image on the sheet 5 by heating sheet 5 according to an image signal, and is pressed to platen roller 6*a* across the sheet 5. More specifically, it is rotatably mounted on the cover member 2 by means of a shaft 6*c* (FIG. 2), and is pressed to the platen roller 6*a* by a compression spring 6*d* when the cover 2 is closed. Thus, the sheet 5 pinched between the platen roller 6*a* and the recording head 6*b* can be transported by the rotation of platen roller 6*a*.

The recording head 6*b* in the present embodiment is a so-called line thermal head having, on a face contacting the sheet 5, plural electric heat-generating elements $6b_1$ arranged in the transverse direction of the sheet 5, and which selectively heats the sheet 5 by current supply to elements $6b_1$ according to the image signal, thereby forming a color on thermal recording sheet 5.

The cutter 7 is composed of a fixed blade 7*a* fixed in the main body 1 and a rotary blade 7*b* rotatable about a shaft 7*c*. This rotary blade 7*b*, when rotated by drive means, slides on the fixed blade 7*a*, thereby cutting the sheet 5 (FIG. 2). This rotary blade 7*b* may be driven by the motor 20 for driving the platen roller 6*a*, or by another independent motor.

The sheet 5, cut by cutter 7, is discharged onto the stacker 9 by the discharge rollers 8 driven by drive means (not shown). This sheet 5, when pulled out from the roll 5*a*, shows curl because it has been wound on the core 5*b*.

Figure 4A:
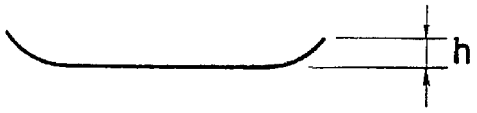
FIGS. 4A and 4B are views showing the curl of a sheet.
Figure 4B:
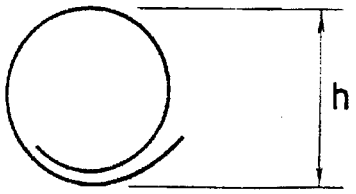

The degree of curl depends on the diameter of the roll 5*a*. The curl height h is smaller for a larger roll diameter as shown in FIG. 4A, but becomes larger and the sheet may eventually be rounded for a smaller roll diameter as shown in FIG. 4B.

In the present embodiment, curl is corrected when the sheet 5 passes through the curl correcting mechanism A. More specifically, a guide shaft 23 constituting a first guide member is movably provided with respect to a second guide member or curl correcting shaft 22 constituting the curl correcting member (decurling member), and the curl correction is achieved by bending in a direction opposite to that of the curl when the sheet 5 is guided by the shafts 22, 23.

Figure 8:
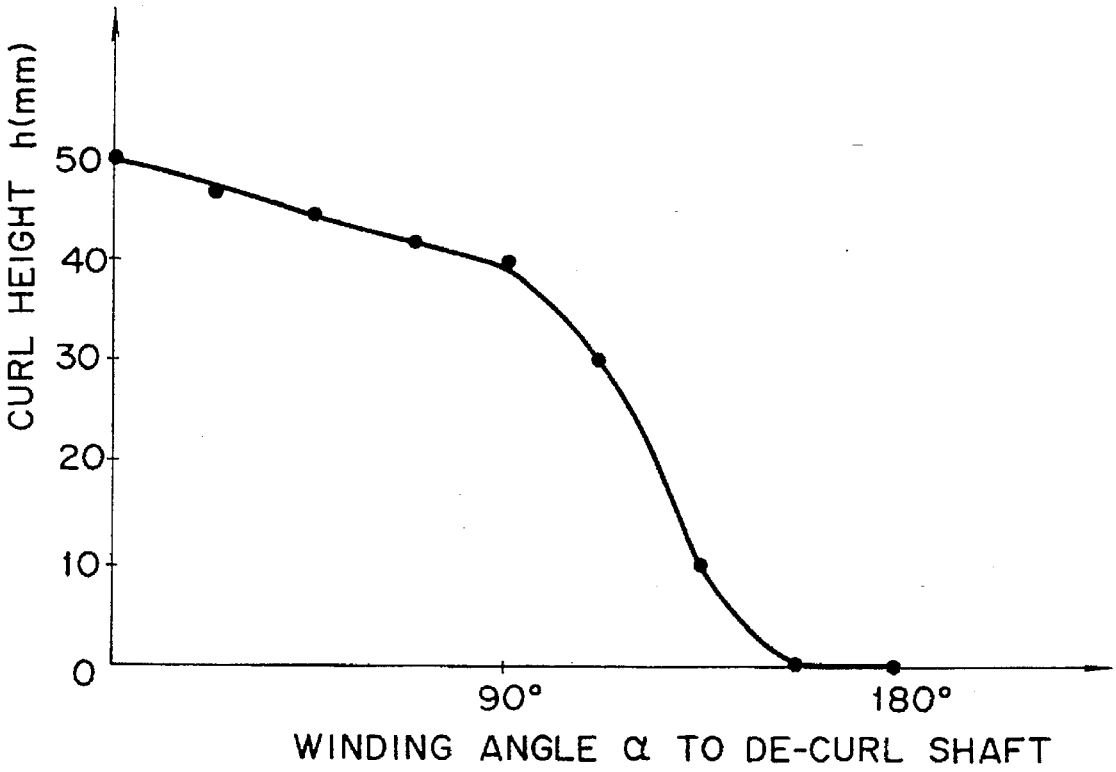
FIG. 8 is a chart showing the relation between the wrapping angle α of the sheet material on the curl correcting shaft and the curl height h.

FIG. 8 is a chart showing the relation between the wrapping angle $\alpha$ of the sheet 5 on the shaft 22 and the curl height h. The data shown in this chart are obtained with a thermal recording sheet of a thickness of 65 μm wound on a core 5*b* of a diameter of 1 inch (25.4 mm), and the curl height is defined by cutting the sheet into a predetermined length (for example 210 mm) and measuring the height of sheet ends when the sheet is placed on a flat place.

As will be apparent from this chart, the curl correcting effect at a wrapping angle $\alpha$ around 90° is not much different from the case without curl correction (wrapping angle is 0°), but the sheet 5 becomes flat by sufficient curl correction at a wrapping angle of 150°–180°. Thus strong curl requires a wrapping angle of 150°–180° for the sheet 5 on the curl correcting shaft 22.

Figure 5A:
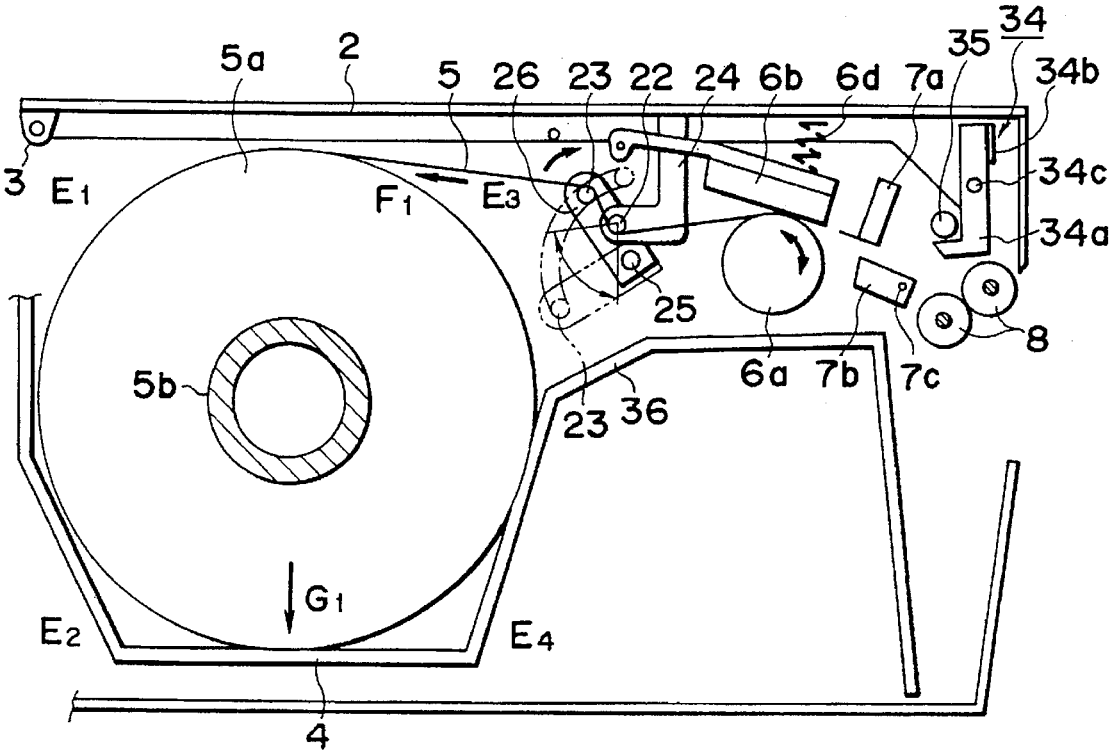
FIG. 5A is a view showing the state of recording with a sheet roll of a large diameter.
Figure 6A:
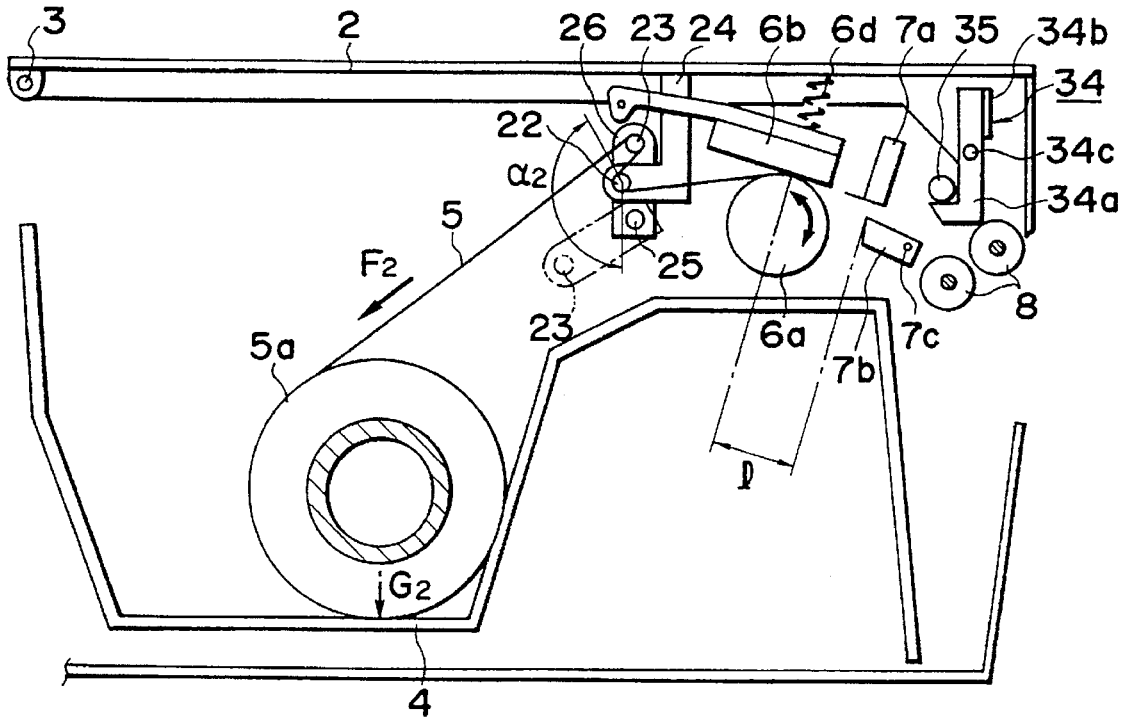
FIG. 6A is a view showing the state of recording with a sheet roll of a small diameter.
Figure 6B:
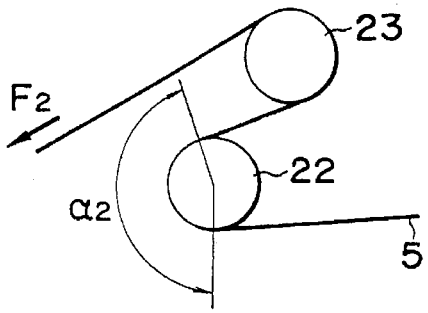
FIG. 6B is a view showing the wrapping of the sheet material on the curl correcting shaft in this state.

In the present embodiment, the first guide member or guide shaft 23 is rendered movable with respect to the second guide member or curl correcting shaft 22 as explained before, so that the wrapping angle of the sheet 5 on the curl correcting shaft 22 can be increased to 150°–180°. Also the guide shaft 23 is biased toward the sheet 5 by the biasing means to be explained later, thereby varying the curl correcting effect for a large roll as shown in FIG. 5A or a small roll as shown in FIG. 6B.

The curl correcting mechanism A will now be explained in greater detail. As shown in FIG. 1, the curl correcting shaft 22 is rotatably supported by a pair of mounting members 24 fixed on the cover member 2. These mounting members 24 stand away the cover member 2 with a distance larger than the width of the sheet 5 but smaller than the distance of arms supporting the guide shaft 23, as will be explained later. The curl correcting shaft 22 is composed for example of a metal shaft of a diameter of about 4 mm, and is at a constant position in the main body 1 when the cover member 2 is closed, as shown in FIGS. 5A and 6A. The position is selected between the roll holder 4 and the platen roller 6*a* in such a manner that the angle of entry of the sheet 5 into the platen roller 6*a* is not excessively large.

In a position opposite to the curl correcting shaft 22 in the main body 1, there is provided a guide member 36 for guiding sheet 5, pulled out from the roll 5*a*, to the platen roller 6*a*. An end of the guide is extended to the vicinity of the platen roller 6*a*, while the other end is integrated with the roll holder 4.

On the other hand, the guide shaft 23 is rendered movable by moving means, in the vicinity of the curl correcting shaft 22, and is composed for example of a metal shaft of a diameter of about 4 mm. The structure of the moving means is shown in FIG. 1. Two arms 26 are fixed on a shaft 25 mounted on the main body 1, and rotatably support the guide shaft 23, whereby arms 26 integrally rotate with the shaft 25 and the guide shaft 23 is rendered movable with respect to the curl correcting shaft 22.

Shaft 25 is rotatably mounted by bearings 27 on the main body 1, and is provided, at an end, with a clutch gear 28, a spring clutch 29 and a crank 30 whereby the shaft 25 receives rotating force in only one direction.

Figure 3:
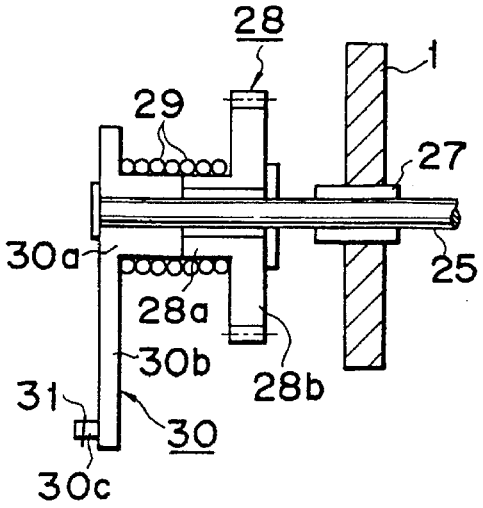
FIG. 3 is a partial cross-sectional view of a rotation transmission system consisting of a clutch gear, a clutch spring and crank.

As shown in FIG. 3, clutch gear 28 is composed of a cylindrical part 28*a* and a gear part 28*b* with an internal diameter slightly larger than the diameter of the shaft 25, so that it can rotate on the shaft 25. Also, crank 30 is composed of a cylindrical part 30*a* fitted on the shaft 25 and a crank arm 30*b*, and rotates integrally with the shaft 25 by a fixing pin (not shown). Spring clutch 29 is composed of a steel wire, a steel belt or a plastic wire wound as a coil over the cylindrical parts 28*a*, 30*a* of the clutch gear 28 and the crank 30, and is fixed at an end on the crank 30.

Spring clutch 29 selectively transmits the rotation of the clutch gear 28, through the clutch 30, to the shaft 25, arms 26 and guide shaft 23. When the clutch gear 28 is rotated in a direction a shown in FIG. 1, the spring clutch 29 is loosened whereby the rotation is not transmitted to the crank 30. On the other hand, when the clutch gear 28 rotates in the opposite direction –a (hereinafter the minus sign indicates a direction opposite to the arrow), the spring clutch 29 is tightened on the cylindrical parts 28*a*, 30*a* to realize a locked state, whereby the rotation is transmitted to the shaft 25 through the crank 30, thus moving the guide shaft 23 in a direction b.

Clutch gear 28 is rotated by the motor 20 for driving the platen roller 6*a*. The rotation of motor 20 is transmitted to the platen roller 6*a* through the gears 21*a* to 21*c* as shown in FIG. 1, and gear 21*c* on the platen roller shaft meshes with the gear part 28*b* of the clutch gear 28 through the intermediate gear 21*d*.

Figure 1:
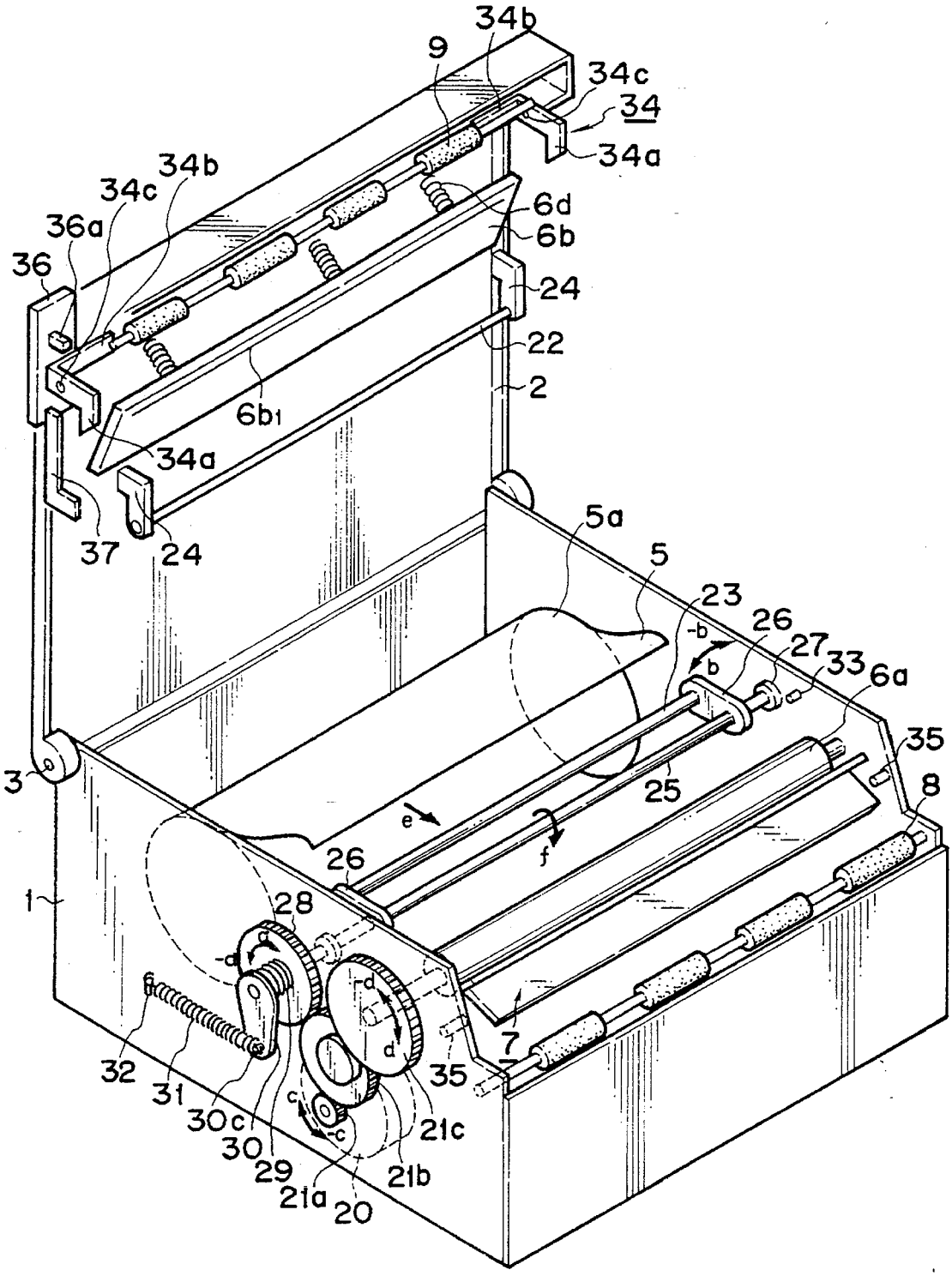
FIG. 1 is a perspective view of a first embodiment of the present invention applied to the recording system of a facsimile apparatus.

Thus, when the motor 20 rotates in a direction c as shown in FIG. 1, the platen roller 6*a* rotates in a direction d, while the clutch gear 28 rotates in a direction a. Stated otherwise, the spring clutch 23 is in the free state when the platen roller 6*a* rotates in a direction for pulling out the sheet 5 in a direction e.

When the motor 20 rotates backward in a direction –c, the platen roller 6*a* rotates in a direction for reversing the sheet 5, and the clutch gear 28 rotates in a direction –a to lock the spring clutch, thereby rotating the guide shaft 23 in a direction b shown in FIG. 1.

On crank 30 there is provided a tension spring 31 for biasing the moving means so as to balance the guide shaft 23 with the tension of the sheet 5. More specifically, a pin 30*c*, provided on an end of the external face of the crank arm 30*b*, supports the tension spring 31 in an extended state, in cooperation with a pin 32 formed in the main body 1, so that crank 30 is constantly subject to a torque in a direction a, by the tension of spring 31. Thus the shaft 25 is constantly biased, by the tension of the spring 31 transmitted through the crank 30, in a direction f shown in FIG. 1, namely in a direction to increase the curl correcting effect of the guide shaft 23.

In a predetermined position in the main body 1 there is provided a stopper 33 for limiting the rotation, in the direction –b, of the arms 26. Stopper 33 comes into contact with the arms 26 in its rotation in the direction –b shown in FIG. 1, thereby limiting the amount of rotation of the arms 26 and defining the maximum value of the wrapping angle of the sheet 5 on the curl correcting shaft 22.

Though not illustrated, there is provided a stopper in the main body 1 for contacting the other end of the clutch spring 29 when the arms 26 rotate in the direction b shown in FIG. 1, thereby loosening clutch spring 29 and preventing the transmission of rotation from the clutch gear 28 to the arms 26.

At the free end of the cover member 2, there are rotatably provided, by means of pins 34*c*, engaging members 34 composed of connecting parts 34*b* and a pair of engaging parts 34*a* formed by bending both ends of the connecting part substantially perpendicularly. On lateral walls of the main body 1 in the vicinity of the discharge rollers 8, there are provided lock means or locking pins 35. When the cover member 2 is in a closed, position engaging parts 34*a* engage with said locking pins 35, whereby the cover member 2 is positioned relative to the main body 1 and is prevented from being opened therefrom. Engaging members 34 are provided with springs (not shown) for biasing for engaging with the lock means or locking pins 35.

In the present embodiment, as explained before, the curl correcting shaft 22 is mounted on the cover member 2 while the guide shaft 23 is mounted on the main body 1 and is rendered movable with respect to the curl correcting shaft 22 in order to increase the wrapping angle of the sheet 5 on the curl correcting shaft 22. However, if the cover member 2 is opened while the guide shaft 23 is positioned substantially above the curl correcting shaft 22, there may result mutual interference of the shafts. Therefore, in the present embodiment, opening member 36 for disengaging the engaging members 34*a* from the lock means or locking pins 35 for opening the cover member 2 is slidably provided on the cover member 2 and is provided with a projection 37 for preventing the interference of the guide shaft 23 and the curl correcting shaft 22 and for opening the sheet convey path.

Figure 7A:
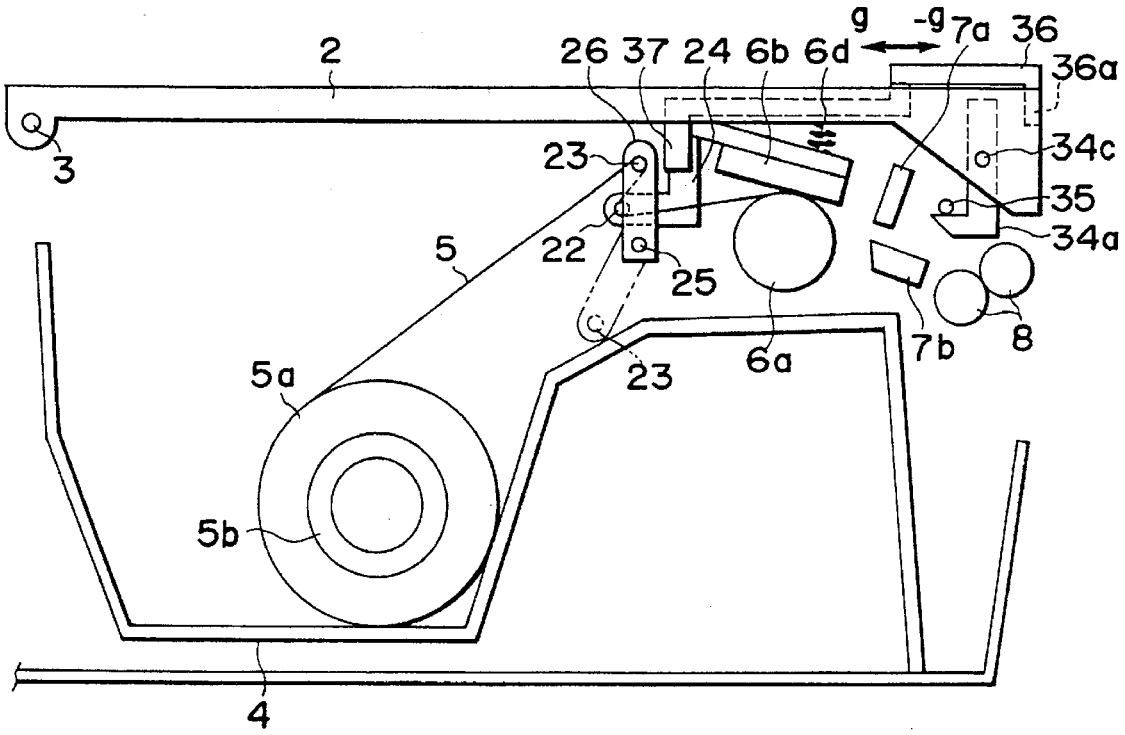
FIGS. 7A to 7C are views showing the operation of sheet roll loading.

The opening member 36 is formed as a flat plate, rendered slidable in directions g and –g shown in FIG. 7A, and is provided with a lock release means or pin 36*a* closer to an end in the longitudinal direction, for rotating the engaging member 34, disengaging it from the lock means or locking pins 35 when moved in the direction g and releasing the hold operation of the locking means or locking pins 35.

The substantially L-shaped projection 37, positioned close to an end of the opening member 36 in the longitudinal direction thereof moves in the direction g when opening member 36 is moved in the appropriate direction, thereby rotating the arms 26 in the direction b, thus separating the guide shaft 23 from the curl correcting shaft 22 and preventing mutual interference thereof by causing the curl correct release means to weaken the curl correct operation. The opening member 36 is provided with a spring (not shown) for biasing in the direction –g.

Figure 5B:
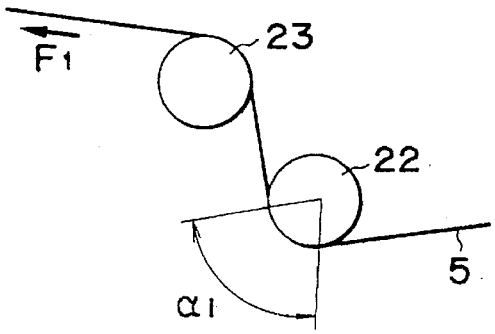
FIG. 5B is a view showing the wrapping of the sheet material on a curl correcting shaft in said state.

In the following there will be explained the recording operation with the recording unit B with the above-explained curl correcting mechanism A, with emphasis on the curl correcting function for a large roll diameter as shown in FIGS. 5A and 5B and a small roll diameter as shown in FIGS. 6A and 6B. In FIGS. 5A and 6A, the opening member 36 and the projection 37 are omitted.

At first the cover member 2 is opened, then the sheet roll 5*a* is loaded in the roll holder 4 and the leading end of the sheet 5 is pulled out to the platen roller 6*a*. Since the curl correcting shaft 22 is mounted on the cover member 2 while the guide shaft 23 is mounted in the main body as shown in FIG. 1, shafts 22, 23 are mutually separated by the opening of the cover member 2, whereby the loading of the sheet 5 is facilitated.

When the cover member 2 is closed and a record start signal is entered, the motor 20 is activated to rotate the platen roller 6*a* in the direction d, thereby advancing the sheet in the direction e. In synchronization the heat-generating elements $6b_1$ of the recording head 6*b* are activated according to an image signal read from an original in another facsimile apparatus and transmitted therefrom, thereby recording an image on the sheet 5. In the transportation of the sheet 5, curl correction is made by the function of the curl correcting mechanism A. The forward rotation of the motor 20 is also transmitted to the clutch gear 28, but the spring clutch 29 reaches the free state as explained before, so that the clutch gear 28 slips with respect to the crank 30.

On the other hand, because the shaft 25 receives the biasing force in the direction f by the tension spring 31, the guide shaft 23 moves by the rotation of the arms 26 in the direction –b, and stops at a position where the biasing force is balanced with the tension of the sheet 5. The sheet 5 pulled out from the sheet roll 5*a* wraps the guide shaft 23 in the direction of curl, and wraps the curl correcting shaft in the opposite direction. The curl of the sheet 5 is corrected by wrapping on the curl correcting shaft 22.

The tension on the sheet 5 is determined by the friction resistance between the roll holder 4 and the roll 5*a* loaded therein. As shown in FIG. 5, the sheet 5 is subjected, before and after the guide shaft 23, to a tension F1, corresponding to the weight G1 of the roll 5*a*. Movement of the guide shaft 23 in the direction –b increases the wrapping angle of the sheet 5 on the shaft 23, whereby the resistance to the rotation of the arms 26 corresponding to said tension F1 (torque on the shaft 25 caused by the spring 31) increases. Thus the arms 26 stop at a position where the tension F1 is balanced with the rotating force of the arms 26.

In case the roll diameter is large as shown in FIG. 5A, the wrapping angle of the sheet 5 on the curl correcting shaft 22 is $\alpha_1$ as shown in FIG. 5B when the tension F1 of the sheet 5 is balanced with the rotating force on the arms 26.

When the roll 5*a* is reduced in diameter as shown in FIG. 6A, the weight thereof also decreases to $G_2$ ($<G_1$) whereby the tension on the sheet 5 is also reduced to F2 (<F1). Consequently the arms 26 rotate further in the direction –b in comparison with the case of larger roll diameter. Thus the arms 26 stop at a position where the rotating force thereof is balanced with the resistance, or at a position in contact with the stopper 36 if the rotating force is larger. In this state the wrapping angle assumes a value $\alpha_2$ as shown in FIG. 6B, larger than $\alpha_1$ for the larger roll diameter.

Consequently, the wrapping angle of the sheet 5 on the curl correcting shaft 22 is smaller or larger respectively for a larger or smaller roll diameter, and a larger wrapping angle provides a higher curl correcting effect as the sheet 5 is bent more strongly in the direction opposite to that of the curl. In this manner the curl correcting effect becomes stronger as the curl gets stronger due to the smaller roll diameter.

An optimum curl correcting effect can be obtained by regulating the tension of the tension spring 31, so as to realize an optimum wrapping angle $\alpha$ corresponding to the diameter of the roll 5*a*. For example, for a roll 5*a* of thermal recording sheet of a width of 210 mm (A4 size), and a thickness of 65 μm wound on a core of 1 inch (25.4 mm), the tension of the spring 31 is preferably so adjusted that the wrapping angle $\alpha_1$ is about 60° to 90° for a large roll diameter as shown in FIG. 5A, but angle $\alpha_2$ is about 150° to 180° for a small roll diameter as shown in FIG. 6A.

As explained above, the curl correcting mechanism A varies the curl correcting effect, according to the level of the curl, by the balance between the tension on the sheet 5 and the rotating force on the arms 26, thereby achieving appropriate curl correction. The arms 26 are biased by the tension spring 31, and the rotation of the motor 20 in the direction c is transmitted to the platen roller 6*a* but not to the arms 26. Consequently, the motor 20 is not subjected to the load for moving the arms 26 at the recording operation, so that the precision of sheet transportation can be improved and image recording of high quality can be achieved.

The sheet 5 subjected to curl correction proceeds to the image recording of a page, then is cut with the cutter 7 and is discharged by the discharge rollers 8.

On the other hand, the sheet 5 remaining in the main body 1 is retracted by a distance l corresponding to the distance between the cutter 7 and the recording means 6 (cf. FIG. 6A), in order to prevent forming a blank at the leading end of the sheet in the next recording operation. For this operation the motor is rotated by a predetermined amount in the reverse direction. The rotation of the motor is transmitted not only to the platen roller 6*a* but also to the crank 30 through the spring clutch 29 in the locked state, thereby rotating the arms 26 in the direction b.

In this state, the arms 26 are subjected to a tension exerted by the spring 31, in a direction to hinder rotation, as shown in FIG. 1. Consequently, the motor 20 in the present embodiment has a driving force at reverse rotation larger than the rotating force of the tension of the spring 31 on the arms 26.

Thus, when the motor 20 is reversed for reversing the sheet 5, the arms 26 rotate in the direction b, thereby being separated from the sheet 5, and return to the initial position (lower limit position of the guide shaft 23) indicated by chain lines in FIG. 5A. In this initial position, the guide shaft 23 does not block the aperture of the roll holder 4, nor interfere with the curl correcting shaft 22 at the opening of the cover member 2. In this state, since the guide shaft 23 is separated from the sheet 5, an inverse curl is not given thereto even if the standby state is prolonged. Also the cutting and reversing of the sheet explained above may be conducted after the image recording of a communication, instead of image recording of each page.

Figure 7B:
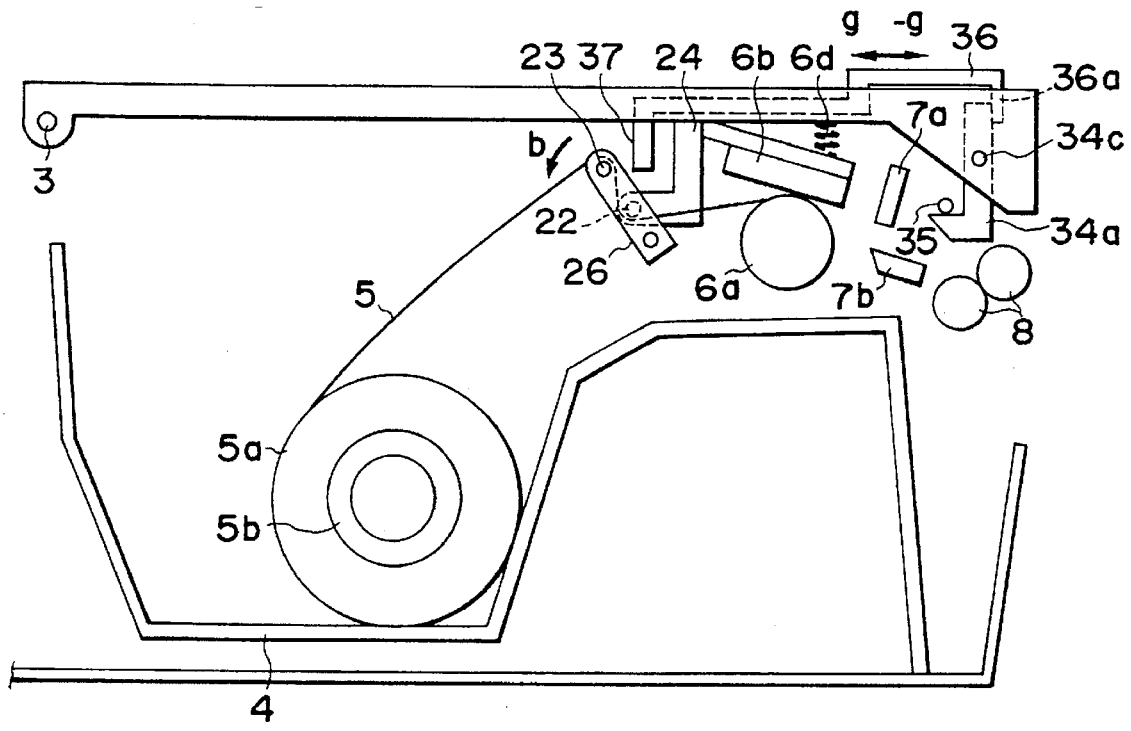
Figure 7C:
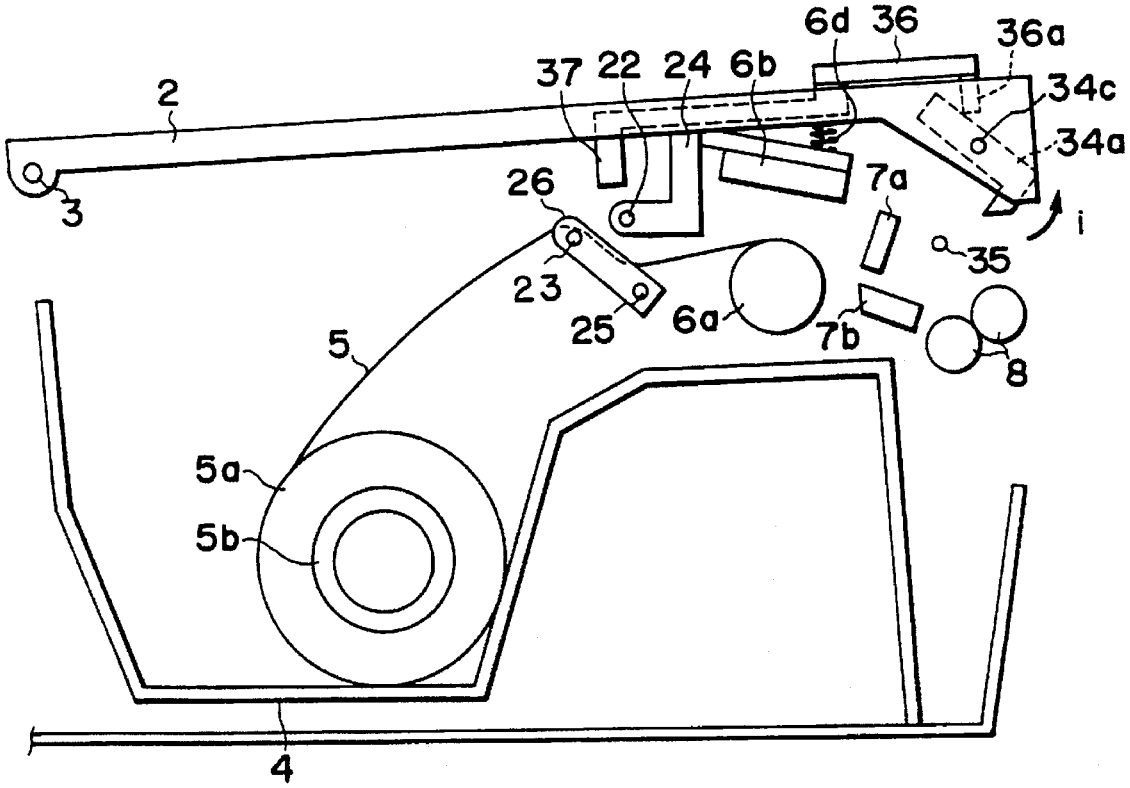

In the following there will be explained the loading operation of the sheet roll 5*a*, with reference to FIGS. 7A to 7C.

At first, for opening the cover member 2, the opening member 36 is moved in the direction g shown in FIG. 7A, whereby the pin 36*a* engages with the engaging part 34*a* to rotate the engaging member 34 in a direction i about the pin 34*c* (cf. FIG. 7C) and disengaging the engaging parts 34*a* from the locking pins 35. Then the cover member 2 is lifted upwards about the pin 3, whereby the recording head 6*b*, mounting members 24 and curl correcting shaft 22 move upwards. The opening member 36 moves in the direction –g to the initial position by the function of the spring (not shown), and the engaging member 34 also moves in a direction opposite to the direction i to the initial position, by the function of the spring (not shown).

In the normal state, as the arms 26 return to the chain-lined initial position (lower limit position of the guide shaft 23) by the reverse rotation of the motor 20, the curl correcting shaft 22 can be moved upwards without interference with the guide shaft 23. However, the guide shaft 23 may be stopped substantially above the curl correcting shaft 22 (solid-lined position in FIG. 7A), for example in case of power breakage in the course of sheet transportation.

In such a case the curl correcting shaft 22 interferes with the guide shaft 23. However, in the movement of the opening member 36 in the direction g, before the pin 36*a* engages with the engaging member 34*a* as shown in FIG. 7B, the projection 37 comes into contact with the arms 26 and rotates arms 26 in the direction b, thereby retracting the guide shaft 23 from the position above the curl correcting shaft 22. In succession the lock release means or pin 36*a* engages with the engaging member 34*a* as shown in FIG. 7C, thereby rotating member 34 in the direction i about the pin 34*c*, thus disengaging the members 34*a* from the lock means on locking pins 35 and releasing a hold operation of said lock means. Therefore, in the upward rotation of the cover member 2 about the pin 3, the guide shaft 23 is retracted from the position substantially above the curl correcting shaft 22, so that the curl correcting shaft 22 can be moved upwards without any interference with the guide shaft 23.

Subsequently the sheet roll 5*a* is replaced with a new one, and the leading end of the sheet is passed over the guide shaft 23 and the platen roller 6*a* and threaded between the cutter members 7*a*, 7*b*. The loading of the sheet 5 is completed by closing the cover member 2.

The amount of rotation of the arms 26 at the reverse rotation of the motor 20 for reversing the sheet 5 by the distance l is selected to be equal to the angle from the solid-lined upper limit position of the guide shaft 23 in FIG. 6A to the broken-lined lower limit position. Stated differently, the distance l between the platen roller 6*a* and the cutter 7, ratio of rotation of the platen roller 6*a* and the shaft 25, and the position of the stopper 33 are so determined that the amount of rotation of the motor 20 for reversing the sheet 5 by the length l becomes equal to the amount of rotation of the motor 20 for rotating the arms 26 in the direction b.

In the following, there will be explained the driving force of the motor required for driving various components in the forward and reverse rotation of the motor 20.

The power $P_1$ of the motor 20 in the forward rotation (for advancing the sheet 5 in the recording direction) is only required to rotate the platen roller 6*a*, since the spring clutch 29 is freed in this state. On the other hand, the power $P_2$ of the motor 20 in the reverse rotation (for reversing the sheet 5) is required to rotate the platen roller 6*a* and to rotate the arms 26 against the force of the tension spring 31 because the spring clutch 29 is locked, and is therefore larger than the power $P_1$ in the forward rotation. However, if the nominal power of the motor 20 is selected to be power $P_2$, the excessive power ($P_2$–$P_1$) of the motor 20 in the forward transportation of the sheet 5 may result in vibration, eventually leading to uneven transportation and noise.

For this reason, in the present embodiment, the motor 20 is driven with a power $P_1$ in the forward rotation and a larger power $P_2$ in the reverse rotation. Such drive is easily achievable by increasing the driving current during reverse rotation above that in the forward rotation, or by reducing the revolution at the reverse rotation.

Even if the driving current is increased or the revolution is reduced, the temperature rise of the motor 20 at the reverse rotation or the delay in reversing of the sheet 5 is negligibly small since the amount l of reversing of the sheet 5 (for example about 20 mm) is sufficiently smaller than the amount of forward transportation for recording (for example 210 mm in case of A4 size).

The rotating speed of the arms 26 driven by the motor 20 is preferably selected to be equal to or slightly higher than the peripheral speed of the platen roller 6*a* (transport speed of the sheet 5), for example by the selection of the appropriate gear ratio. In this manner the guide shaft 23 returns rapidly to the lower limit position at the reversing of the sheet 5.

The motor 20 is stopped after reversing the sheet 5 by the predetermined amount l, and the arms 26 are biased by the tension spring 31 in this state. As shown in FIG. 1, this tension tends to rotate the shaft 25 in the direction f, thereby locking the spring clutch 29 and biasing the clutch gear 28 in the direction a, and functions as a torque for rotating the motor 20 through the gears 21*a* to 21*d*.

For example, for a torque T1 (for example 1 kg·cm) for rotating the shaft 25 in the direction f and for a revolution ratio of 10:1 between the motor 20 and the clutch gear 28, the torque T2 transmitted to the motor 20 is equal to T1/10 (0.1 kg·cm). In the present embodiment, therefore, in order to prevent rotation of the arms 26 in the stopped state of the motor 20, the self-retaining torque of the motor 20 (torque for maintaining the rotor consisting of permanent magnets stationary against an externally applied torque) is selected at a level (for example 0.2 kg·cm) higher than the above-mentioned torque T2 transmitted to the motor 20.

Thus, in the recording apparatus of the present embodiment, the arms 26 are maintained at the chain-lined initial position shown in FIGS. 6A and 6B in the standby state for recording.

Consequently, at the loading of the sheet roll 5*a*, the cover member 2 can be smoothly opened without interference between the guide shaft 23 and the curl correcting shaft 22. Also even if the guide shaft is stopped substantially above the curl correcting shaft 22 for example by power breakage, the cover member 2 can be smoothly opened without interference, since the opening member 36 forcedly retracts the guide shaft 23 from above the curl correcting shaft 22 as explained above.

In the following there will be explained variations of the curl correcting shaft 22 and the guide shaft 23.

In the foregoing first embodiment, the guide shaft is rendered movable with respect to the curl correcting shaft, but it is possible to render the curl correcting shaft 22 movable. Also in the foregoing embodiment, the guide shaft 23 is mounted on arms and is moved by the rotation of the arms, but the moving means is not limited to such structure. For example, the guide shaft 23 or the curl correcting shaft 22 may be moved in a parallel manner along racks or rails, or may be moved by an upward movement caused for example by a cam. Furthermore both the second guide means or curl correcting shaft 22 and the first guide means or guide shaft 23 may be rendered movable by respective position change means to allow the position between the first and second guide means to be changed.

Also in the foregoing embodiment the curl correcting shaft 22 and the guide shaft 23 are composed of metal shafts, but they may also be composed for example of a metal plate formed with a predetermined curvature to constitute a surface coming into contact with the sheet 5. Furthermore, the spring clutch 29 for selectively transmitting the power of the motor to said guide shaft 23 may be replaced, for example, by a needle clutch of the roller type.

Also in the foregoing embodiment the movement of the guide shaft 23 and the rotation of the platen roller 6*a* are achieved by the motor 20, but there may naturally be employed separate motors. Furthermore such driving power need not necessarily be supplied by motors but may be provided for example by plungers.

Furthermore, the tension spring 31, used for biasing the curl correcting shaft 22 in a direction for increasing the curl correcting effect, may be replaced for example by a spring such as torsion coil spring, compression or spiral spring, or a cylinder such as an air cylinder or oil cylinder, or a magnet.

In the following there will be explained variations of the opening member 36 and the interference preventing member 37.

In the foregoing embodiment, the opening member 36 is integrated with the pin 36*a* and the projection 37 for actuating the engaging part 34*a* and the arms 26, but such actuation may be achieved by link members or the like separate from the opening member 36. It is also possible to detect the sliding motion of the opening member 36 for example with a microswitch, and to reverse the motor thereby moving the arms 26 to the chain-lined position shown in FIG. 5A. In such case, the arms 26 may be moved by a driving source separate from the motor for the platen roller 6*a*.

The recording system explained above has been applied to a thermal recording apparatus employing a thermal recording sheet, but it is likewise applicable to a thermal transfer recording apparatus for transferring ink from an ink sheet to a plain paper sheet.

Also in the above-explained first embodiment, the curl correcting mechanism A is accommodated in a space $E_4$ in four dead spaces $E_1$, $E_2$, $E_3$ and $E_4$ resulting from housing the circular sheet roll 5*a* in the rectangular main body 1 and the moving range of the guide shaft 23 is limited within space $E_4$, so that the rate space in the main body is utilized more efficiently, and the apparatus can be easily miniaturized.

In the following there will be explained a second embodiment of the present invention.

Figure 9:
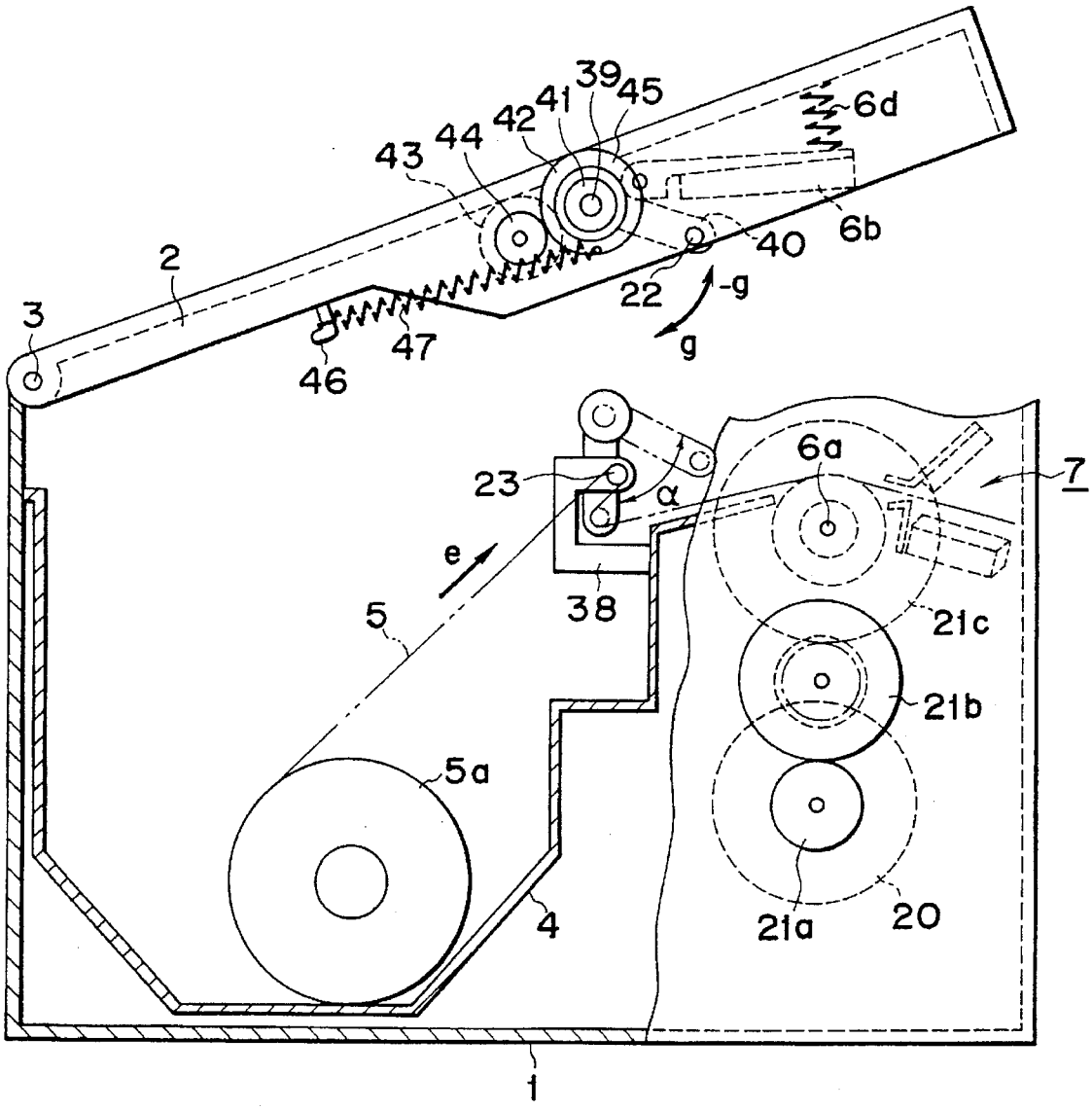
FIG. 9 is a cross-sectional view of a second embodiment.

FIG. 9 shows a second embodiment in which the curl correcting shaft 22 is rendered movable, in contrast to the foregoing first embodiment in which the guide shaft 23 is rendered movable with respect to the curl correcting shaft 22. In FIG. 9, the same or equivalent components to those in the first embodiment are represented by the same numbers, and will not be explained further.

Referring to FIG. 9, the guide shaft 23 is rotatably supported by support members 38 in a position above the main body 1. On the other hand, the curl correcting shaft 22 is rotatably mounted on arms 40 fixed on a shaft 39 rotatably provided on the bottom side of the cover member 2, and is so constructed as to correct the curl of the sheet 5 when moved by the arms 40 in a direction g or to be released from the curl correcting action when moved in a direction –g. It moves, as indicated by chain lines in FIG. 9, within a range between the roll holder 4 and the platen roller 6*a* and above the main body 1.

On an end of shaft 39 there is rotatably provided a clutch gear 42 with a solenoid clutch 41, which selectively transmits the rotation of the clutch gear 42 to shaft 39, in response to a signal from a control unit (not shown). Clutch gear 42 meshes with a gear 44 fixed on the shaft of a motor 43.

On the other end of shaft 39 there is mounted a pulley 45, and a tension spring 47 is mounted between a pin provided on the periphery of pulley 45 and a hook 46 fixed on a predetermined position of the cover member 2, thereby constantly biasing the arms 40 in the direction g.

In the standby state for recording, solenoid clutch 41 is energized, so that the arms 40 are maintained at the chain-lined position in FIG. 9 by the self-sustaining force of the motor 43. Thus the cover member 2 can be opened without mutual interference of the curl correcting shaft 22 and the guide shaft 23, so that the roll 5*a* can be easily replaced.

At the recording, the cover member 2 is closed and the motor 20 is activated by advancing the sheet 5 in the direction e by the rotation of the platen roller 6*a*. At the same time the recording head 6*b* is driven according to the image signal thereby recording an image on the sheet 5. Simultaneous with the activation of motor 20, the solenoid clutch 41 is turned off, whereby the arms 40 rotate in the direction g by the tension of the spring 47 and the curl correcting shaft 22 comes into contact with the sheet 5 as indicated by solid lines in FIG. 9. Curl correcting shaft 22 moves, as in the first embodiment, to a position where the biasing force of the tension spring 47 is balanced with the tension of the sheet 5, and the curl correction is achieved by the bending of the sheet 5 in a position opposite to that of curl by the curl correcting shaft 22.

When the recording is completed, the motor 20 is reversed to retract the front end of the sheet 5 from the cutter 7 to the platen roller 6*a*. At the same time the solenoid clutch 41 is energized and the motor 43 is reversed by a predetermined amount, thereby rotating the arms 40 in the direction –g. The amount of rotation of the arms is the same as in the first embodiment. Thus the arms 40 return to the chain-lined position in FIG. 9, and is retained in that position.

As explained in the foregoing, the same effect as in the first embodiment can be obtained by the movable structure of the curl correcting shaft 22.

In the present embodiment, the curl correcting shaft 22 is mounted on arms and is rendered movable by the rotation of the arms, but the moving means is not limited to such structure. For example the guide shaft 23 or the curl correcting shaft 22 may be made capable of parallel movement along racks or rails, or may be moved by a pushing motion of a cam.

Furthermore, both the curl correcting shaft 22 and the guide shaft 23 may be rendered movable by combining the first and second embodiments. In the present embodiment, the curl correcting shaft 22 and the guide shaft 23 are composed of metal shafts, but they may also be formed of a metal plate bent with a predetermined curvature to constitute the surface coming into contact with the sheet 5.

The solenoid clutch 41, used in the present embodiment for selectively transmitting the rotation of the motor to the curl correcting shaft 22 or the guide shaft 23, may be replaced for example by a needle clutch of roller type.

The movement of the guide shaft 23 and the rotation of the platen roller 6*a* are achieved by the motor 20, but there may be employed separate motors for these purposes. Also instead of such motors, there may be employed other driving sources such as plungers.

Also the tension spring 31, employed for biasing the curl correcting shaft 22 or the guide shaft 23 in a direction for increasing the curl correcting effect, may be replaced by a spring such as torsion coil spring, compression spring or spiral spring, a cylinder such as air cylinder or oil cylinder, or a magnet.

The above-explained recording system has been applied to a thermal recording apparatus employing a thermal recording sheet, but it is likewise applicable to a thermal transfer recording apparatus in which ink is transferred from an ink sheet to a plain recording paper sheet.

In the following, there will be explained experimental results of curl correction on the sheet 5 of different roll diameters, by means of the curl correcting mechanism A of the first embodiment.

The sheet 5 used in this experiment consists of a thermal recording sheet of a width of 210 mm (A4 size) and a length of 100 m, wound on a core 5b of 1 inch (25.4 mm) in diameter. In the unused state, the roll had a diameter of 96 mm. The tension spring 32 was so adjusted to obtain a torque of 1 kg·cm on the arms 26. The curl correcting shaft 22 has a diameter of 4 mm, and the moving radius of the guide shaft was 13 mm. Also the wrapping angle θ of the sheet 5 on the curl correcting shaft 22 is made variable in a range from 130° to 30°, and the result was observed after transportation of the sheet 5 by 297 mm (length of A4 size).

Figure 10:
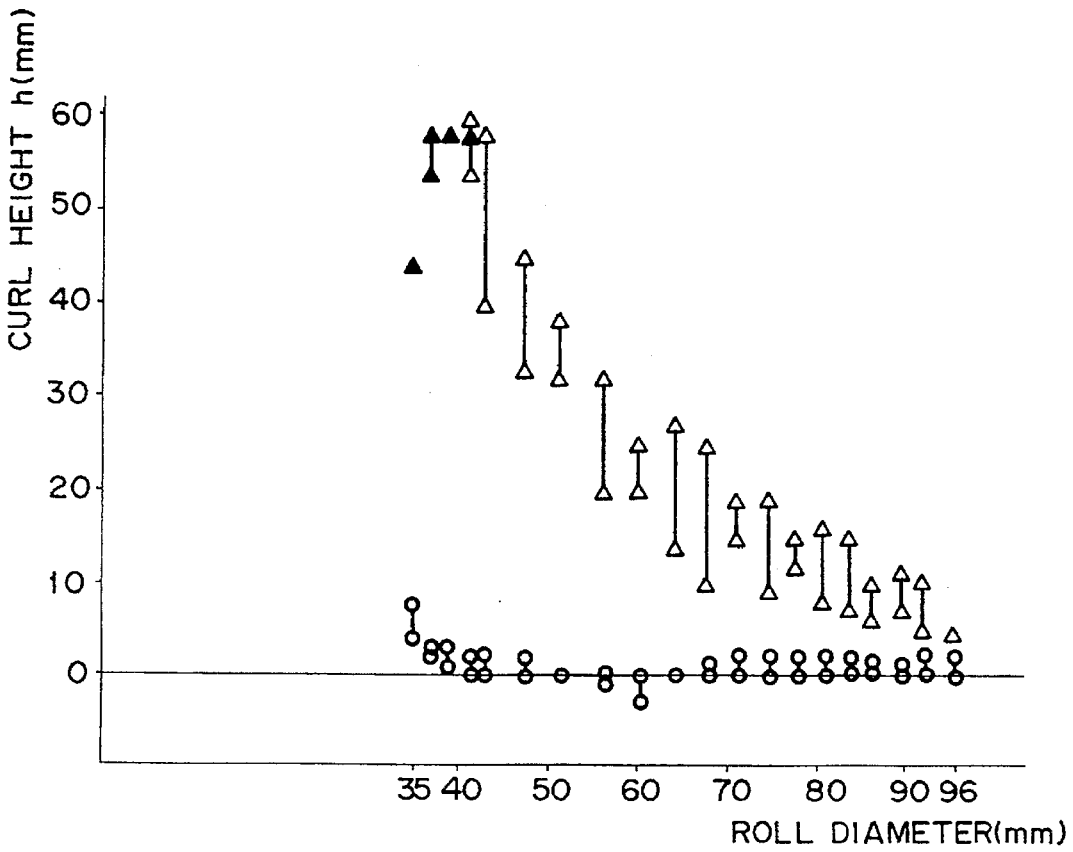
FIG. 10 is a chart showing the relation between the sheet roll diameter and the curl height.

FIG. 10 shows the results of the experiment, in which white triangles indicate a curl state as shown in FIG. 4A without curl correction, black triangles indicate a curl state as shown in FIG. 4B without curl correction, and white circles indicate a curl state as shown in FIG. 4A after the curl correction with mechanism A.

As will be apparent from these results, the curl height h of the sheet 5 decreases as the roll diameter increases, and vice versa. A rounded curl is generated when the roll diameter becomes equal to or smaller than about 40 mm.

On the other hand, the sheet subjected to curl correction by the above-explained mechanism A was almost free from curl, and the measured curl height h was almost constant.

As explained in the foregoing, the curl correcting mechanism A varies the curl correcting effect according to the level of the curl, by the balance between the tension on the sheet 5 and the torque on the arms 26, thereby appropriately correcting the curl. Also the arms 26 are biased by the tension spring 32, and the rotation of the motor 20 in the direction c is transmitted to the platen roller 6a but not to the arms 26. Consequently, at the recording operation, the motor 20 is not given the load for moving the arms 26 and can improve the precision of transportation, whereby recording of high image quality can be achieved.

In the following there will be explained, in the first embodiment, the relation between the rotation angle θ of the guide shaft 23 for assuming an appropriate position corresponding to the diameter of the sheet roll 5a and the torque T of the shaft 25, with reference to FIG. 11.

Figure 11:
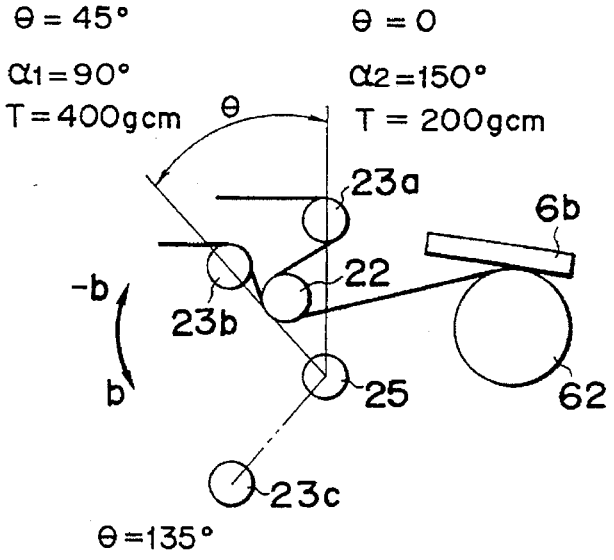
FIGS. 11 and 12A to 12C are schematic views showing the relation between the rotation angle θ of a guide member and the torque T.

Referring to FIG. 11, when the sheet roll 5a has a small diameter (for example only 1 meter of sheet is left), the motor 20 rotates in the direction c to rotate the shaft 25 in the direction a, whereby the guide shaft moves in the direction −b, about the shaft 25, to a position 23a. In this state the wrapping $\alpha_2$ of the sheet 5 on the curl correcting shaft 22 is 150°. In order to stabilize the guide shaft 23 in this position, the shaft 25 requires a torque T of 200 g·cm in the direction −b.

For a roll of larger diameter (for example an unused roll with sheet of 100 m), the motor 20 rotates in the direction c to rotate the shaft 25 in the direction a, whereby the guide shaft 23 moves in the direction −b, about the shaft 25, to a position 23b. In this state the wrapping angle $\alpha_1$ is 90°. Because of the higher sheet tension than in the smaller roll diameter, the guide shaft is pulled back in the direction b by θ=45. In order to stabilize the guide shaft 23 in this position, the shaft 25 requires a torque T of 400 g·cm in the direction −b.

In the standby state for recording, the motor 20 rotates in the direction −c to rotate the shaft 25 in the direction −a beyond the position for the large-diameter roll, whereby the guide shaft 23 moves in the direction b from position 23a to a position 23c where θ=135°.

The relation among the torque T, the wrapping angles $\alpha_1$, $\alpha_2$ on the curl correcting shaft 22 and the curl may be suitably selected according to the kind of sheet 5 (core diameter, sheet thickness etc.), or the torque T may always be constant. Also the maximum torque T may be selected for an arbitrary roll diameter instead of the largest roll diameter.

In the foregoing embodiment, the position 23a of the guide shaft 23 for a roll 5a of a small diameter is taken as reference, and the torque T increases with the increase of the rotation angle θ of the guide shaft 23 within a range of 0°–45° in the direction b. Then the torque T decreases beyond θ=45°, and reaches minimum at the standby state for recording.

Figure 12A:
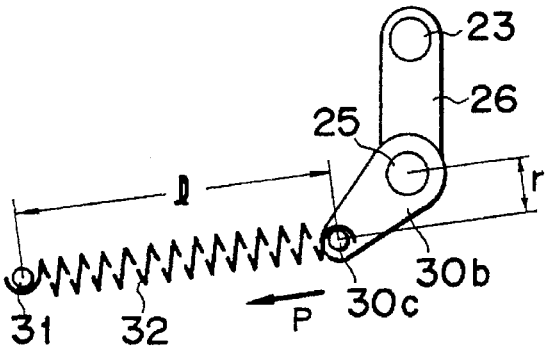
Figure 12B:
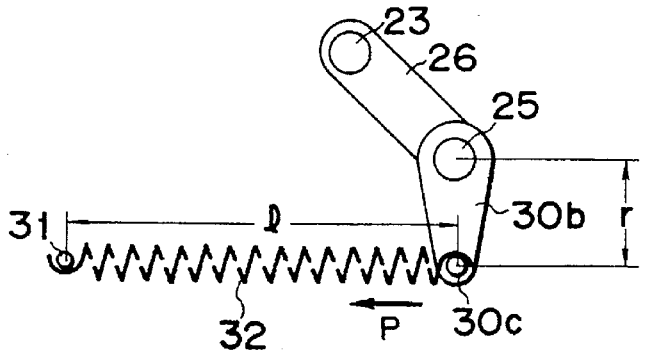
Figure 12C:
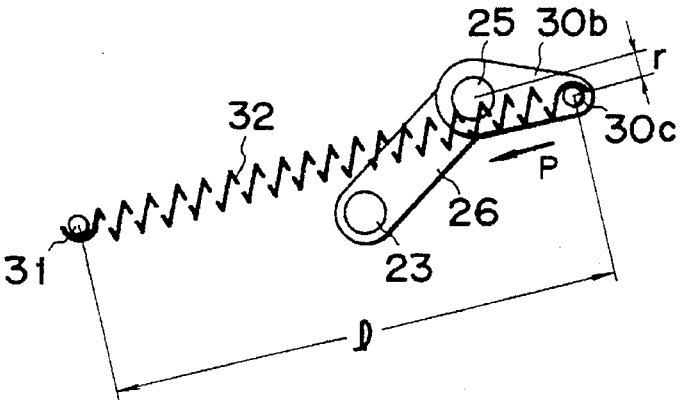

In the following there will be explained the structure for realizing the above-explained relation between the rotation angle θ of the guide shaft 23 and the torque T, with reference to FIGS. 12A to 12C, wherein l is the length of the tension spring 32, P is the elastic force thereof, and r is the perpendicular distance of the shaft 25 to the direction of action of the elastic force P. FIGS. 12A, 12B and 12C respectively show a case of using a small roll, a case of using a large roll and a standby state for recording.

The torque T exerted by the tension spring 32 on the shaft 25 in the direction −a through the crank 30 is given by:

T=Pr.

When the small roll corresponding to FIG. 12A is replaced by a large roll, the crank 30 and the shaft 25 are pushed back in the direction −a by the tension of the sheet 5, whereby the guide shaft 23 rotates in the direction b. In this state the tension spring 32 is extended, so that the elastic force P thereof increases. Also the perpendicular distance r of the shaft 25 to the line of action of said elastic force P increases, thus increasing the torque T. The torque T reaches a maximum when the center line of the crank plate 30a becomes perpendicular to said line of action.

In the standby state for recording, the crank 30 and the shaft 25 rotate further in the direction −a than in the position for the large roll, and the guide shaft 23 rotates in the direction b. In this state, as shown in FIG. 12C, the tension spring 32 is further extended to increase the elastic force P. However, the torque T decreases because distance r decreases significantly.

Figure 13:
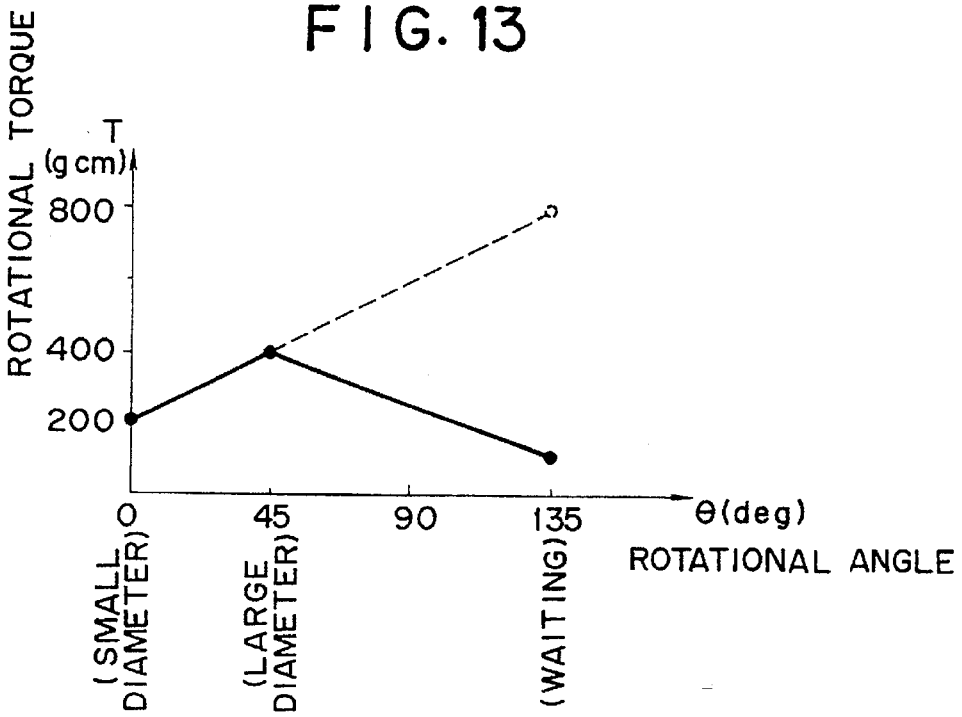
FIG. 13 is a chart showing the relation between the rotation angle e and the torque T.

The above-explained functions are summarized in FIG. 13, in which a broken line indicates a case of applying the torque on the shaft 25 for example with a torsion coil spring. In this case, the standby state requires a torque of about 800 g·cm which is about twice the torque required for the large roll. Consequently, a larger output is required for the motor 20 for rotating the shaft 25, and this will result in fluctuations in the load on the platen roller 6a.

In the present embodiment, however, the rotational torque T of the shaft 25 corresponding to the angle θ of the guide shaft 23 is selected for a relatively large arbitrary roll diameter, whereby the output of the motor 20 required, in the standby state for recording, for rotating the guide shaft 23 against the force P of the tension spring 23 is reduced, so that the entire apparatus can be compactized.

The relation between the rotation angle θ of the guide shaft 23 and the rotational torque T of the shaft 25 is not limited to that in the foregoing embodiment, but can be determined by suitable selection of the spring constant of the tension spring 32, shape of the crank 30 and positions of the pins 30b, 31. It is also possible to select the torque to be larger for a small roll diameter than for a large roll diameter. It is furthermore possible to select the torque T constant for any roll diameter (namely regardless of the position of the guide shaft 23), by using a constant torque mechanism such as a slip clutch or a negator spring.

In the following there will be explained a third embodiment employing another structure as moving means for the guide shaft 23.

Figure 14:
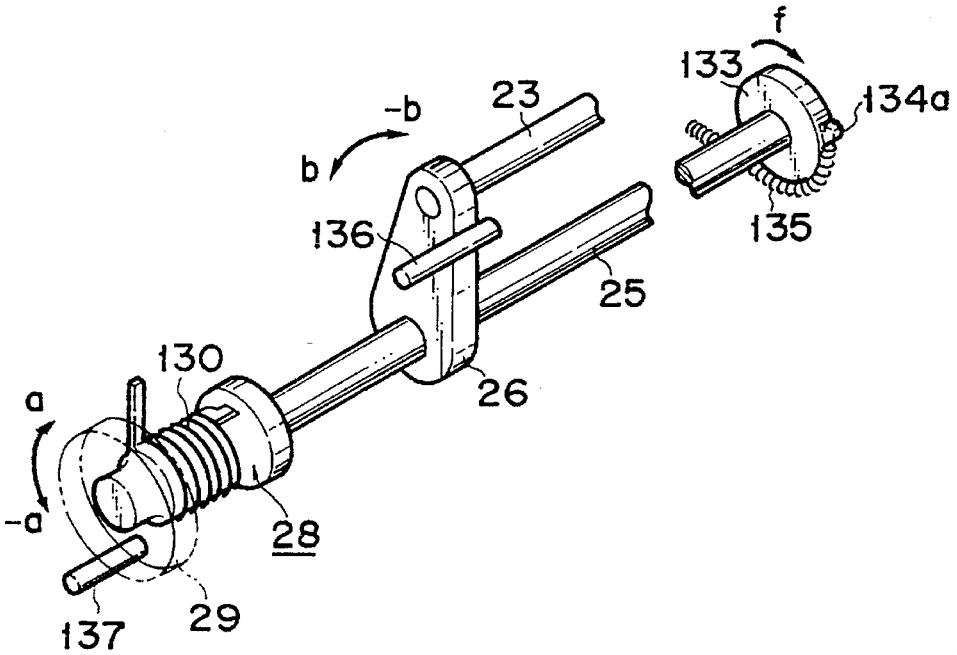
FIG. 14 is a perspective view of a third embodiment of the curl correcting device.
Figure 15:
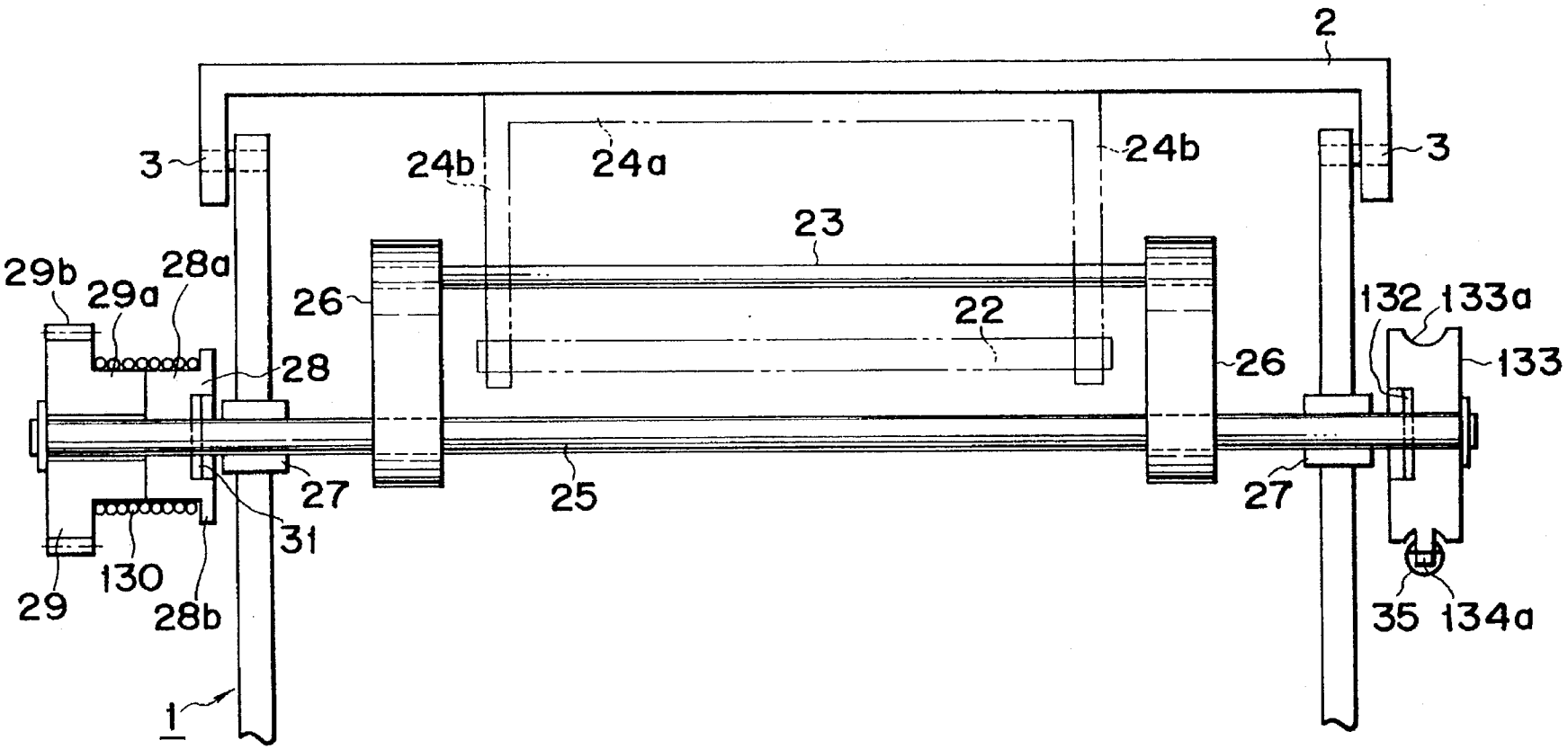
FIG. 15 is an elevation view thereof.

As shown in a perspective view in FIG. 14 and a cross-sectional view in FIG. 15, the moving means has a shaft 25 mounted in the main body 1 and provided with two arms 26. Arms 26 support the guide shaft 23 in rotatable manner. Thus the rotation of the shaft 25 moves the arms 26 whereby the guide shaft 23 is rendered movable with respect to the curl correcting shaft 22.

Shaft 25 is rotatably mounted in the main body 1 by means of bearings 27, and, on an end, there are mounted a clutch flange 28, a clutch gear 29 and a spring clutch 130 to transmit the rotation to the shaft 25 only in one direction. Clutch flange 28 is composed of a cylindrical part 28*a* and a flange part 28*b*, which integrally rotate with the shaft 25 by means of a fixing pin 131.

The clutch gear 29 is composed of a cylindrical part 29*a* and a gear part 29*b*, and has an internal hole slightly larger than the diameter of the shaft 25, thereby being rotatable with respect thereto.

The spring clutch 130 is composed of a steel wire, a steel belt or a plastic wire which is wound to form a coil over the cylindrical parts 28*a*, 29*a* of the clutch flange 28 and clutch gear 29, and an end is fixed on the flange part 28*b* of the clutch flange 28 while the other end is bent to form an engaging part 30*a*. Spring clutch 130 transmits the rotation of the clutch gear 29 only in one direction but not in the other direction.

When the clutch gear 29 rotates in the direction a shown in FIG. 14, the spring clutch 130 is in a loosened free state, whereby the rotation is not transmitted to the clutch flange 28. On the other hand, when the clutch gear 29 rotates in the opposite direction –a, the spring clutch 130 is tightened around the cylindrical parts 28*a*, 29*a* and locks the parts, whereby the rotation is transmitted to the clutch flange 28 for moving the guide shaft 22 in a direction b.

Figure 16:
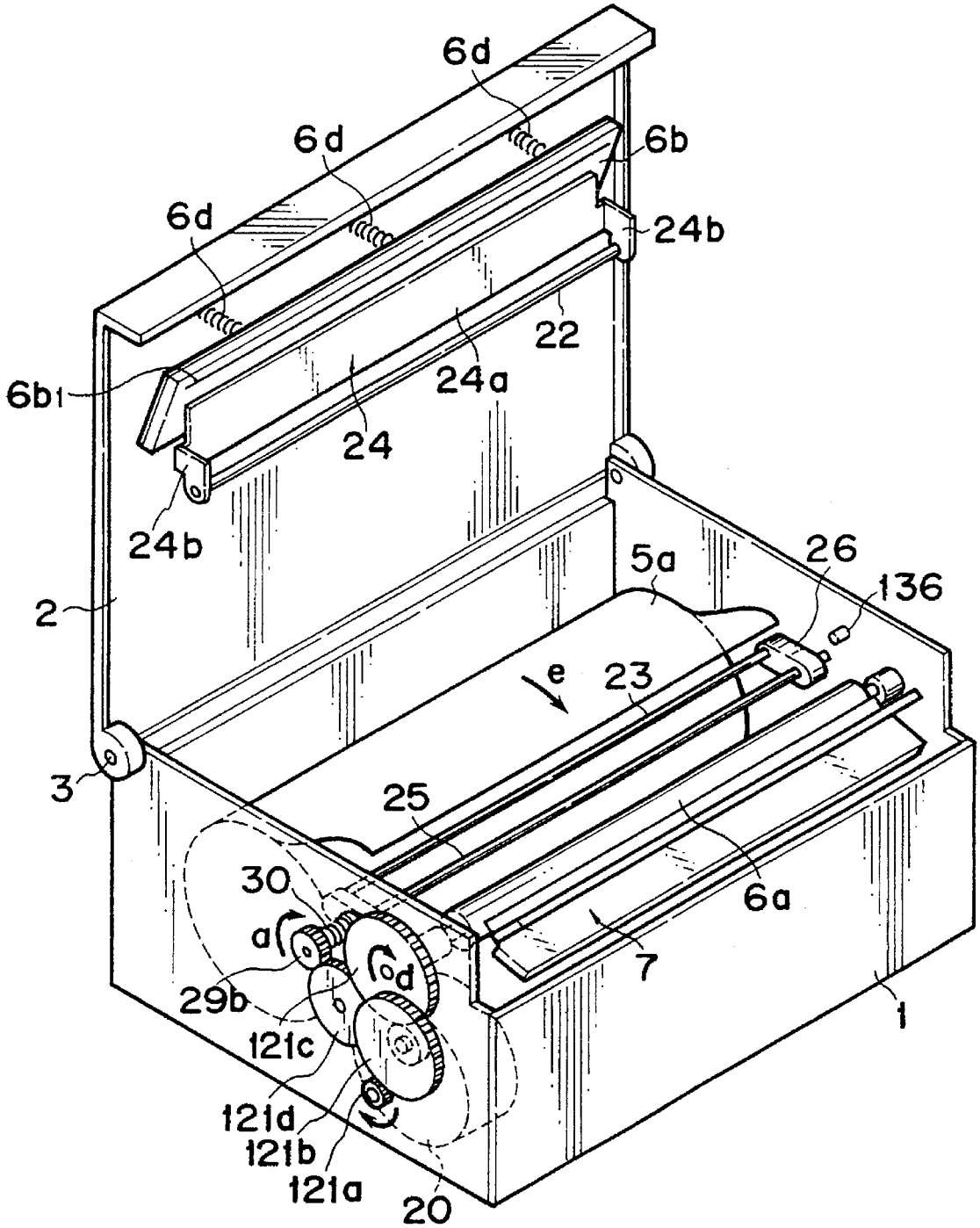
FIGS. 16 and 17 are perspective views of a facsimile apparatus.

Clutch gear 29 is driven by the motor 20 used for rotating the platen roller 6*a*. As shown in FIG. 16, the rotation of the motor 20 is transmitted to the platen roller 6*a* through gears 121*a* to 121*c*, and the gear 121*c* mounted on the platen roller shaft meshes with the gear part 23*b* of the clutch gear 29 through an intermediate gear 121*d*.

Thus the forward rotation of the motor 20 in the direction c shown in FIG. 16 rotates the platen roller 6*a* in the direction d, and the clutch gear 29 in the direction a. Consequently, the spring clutch 130 is in the free state when the platen roller 6*a* rotates in a direction to advance the sheet 5 in the direction e. On the other hand, when the motor 20 rotates in the opposite direction –c, the platen roller 6*a* rotates in a direction to retract the sheet 5, and the clutch gear 29 rotates in the direction –a to lock the spring clutch 130, whereby the rotation is transmitted to move the guide shaft 23 in the direction b shown in FIG. 14.

In the following there will be explained biasing means for biasing the guide shaft 23 so as to be balanced with the tension of the sheet 5.

Figure 17:
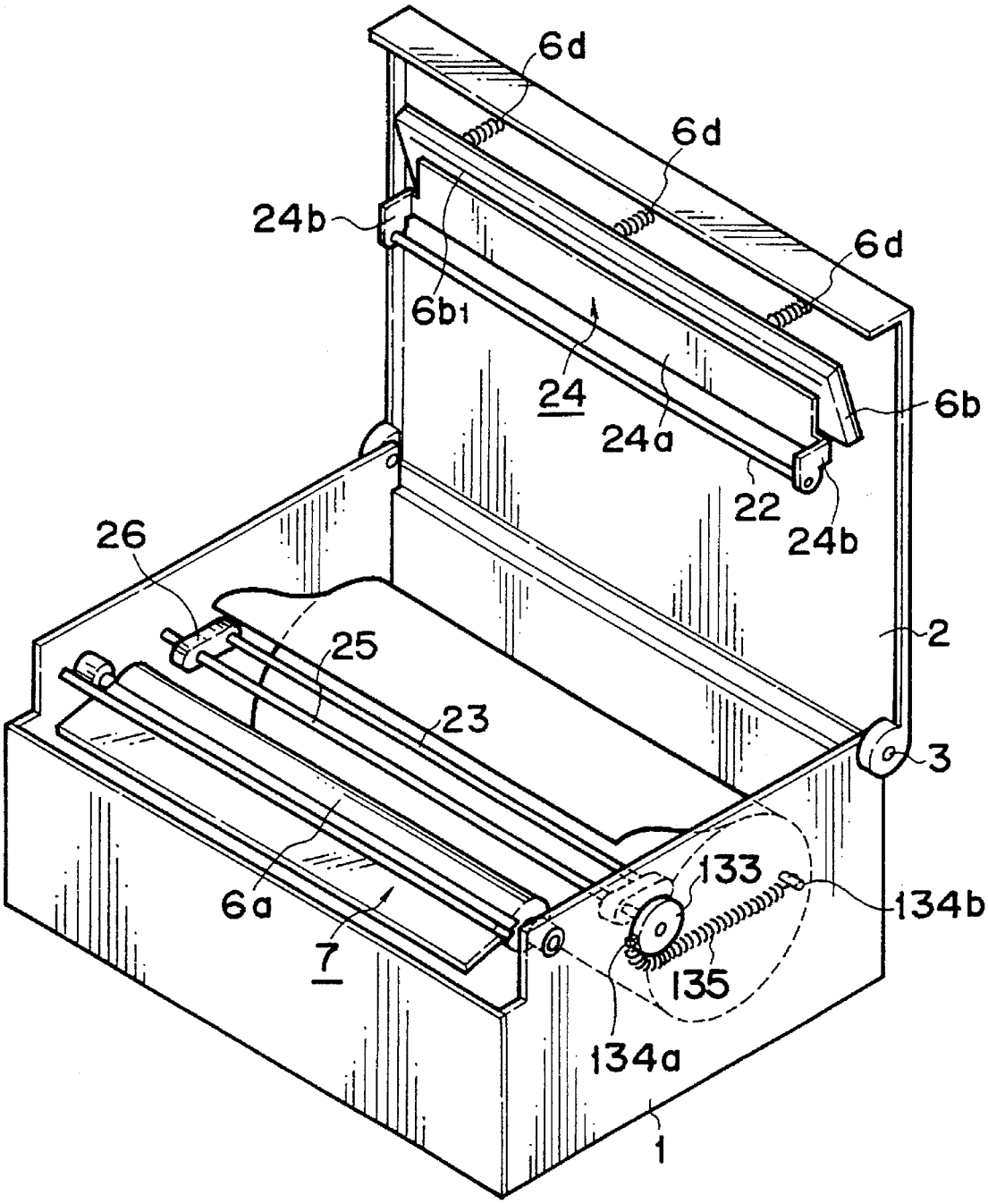

On the other end of the shaft 25, as shown in FIGS. 14 and 15, there is fixed a pulley 133 by means of a fixing pin 132. Pulley 133 is provided with a groove 133*a* on the periphery thereof and a hook 134*e* at a predetermined position. A tension spring 135 is provided under a tension between hook 134*a* and another hook 134*b* provided in a predetermined position of the main body 1 (cf. FIG. 17), whereby the pulley 133 is constantly biased in a direction f in FIG. 14, namely in a direction for increasing the curl correcting effect by the guide shaft 23.

Stopper 136 is also provided within the moving range of said arms 26 in the main body 1. Stopper 136 constitutes limiting means which comes into contact with the arms 26 in the rotation thereof in the direction –b shown in FIG. 14, thereby limiting the amount of rotation in direction –b, and thus defining the maximum wrapping amount of the sheet 5 on the curl correcting shaft 22.

Figure 18C:
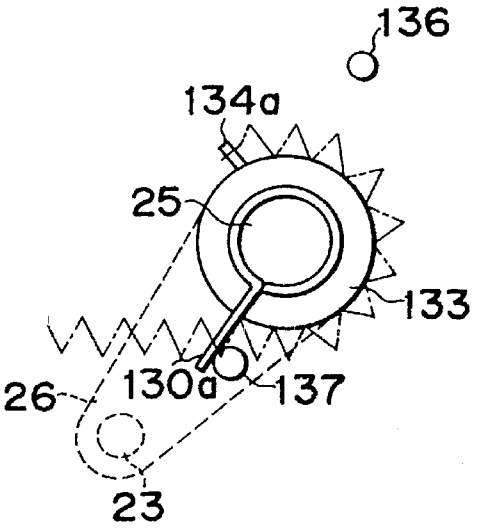
FIGS. 18A to 18C are views showing the relation between a spring clutch and a stopper.
Figure 18B:
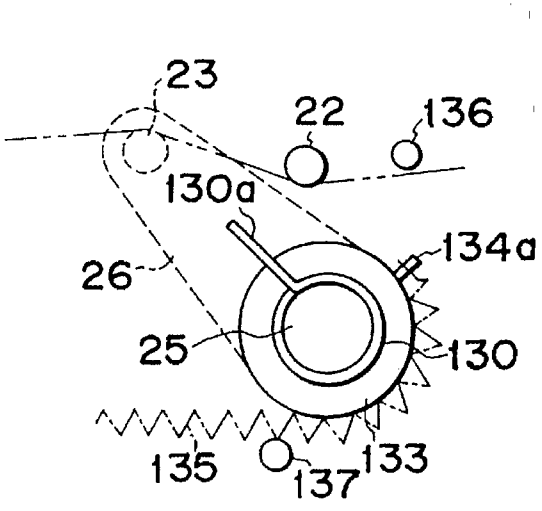
Figure 18A:
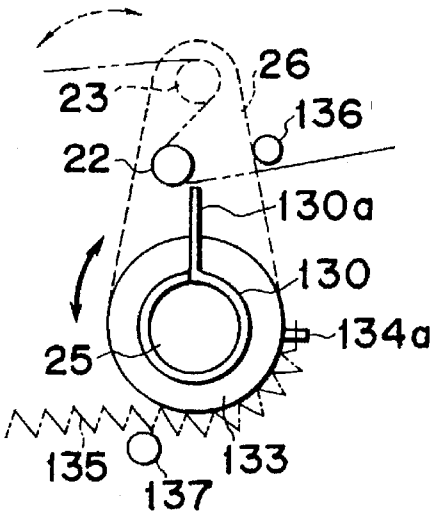

There is further provided a stopper 137 within the rotation range of the engaging part 130*a* of the spring clutch 130 in the main body 1, as shown in FIGS. 14 and 18. Stopper 137 constitutes limiting means for limiting the rotation of the spring clutch 130, rotating in the locked state with the clutch gear 29 in its rotation in the direction –a, thereby limiting the rotation of the arms 26. When the clutch gear 29 rotates in the direction –a while engaging part 130*a* is in contact with the stopper 137, spring clutch 130 is loosened whereby the rotation is not transmitted to the clutch flange 28 and the rotation of the arms 26 in the direction b is limited. Consequently the arms 26 rotate within a range defined by the stoppers 136, 137.

Also in the present embodiment, the arms 26 stop at a position where the tension of the spring 135 is balanced with the tension F1 of the sheet 5, caused by the friction between the roll holder 4 and the sheet roll 5*a*.

In case the roll diameter is large as shown in FIG. 5A, the wrapping angle of the sheet 5 on the curl correcting shaft 22 is $\theta_1$ as shown in FIG. 5B when the tension F1 of the sheet 5 is balanced with the rotating force on the arms 26.

When the roll 5*a* is reduced in diameter as shown in FIG. 6A, the weight thereof also decreases to $G_2$ ($<G_1$) whereby the tension on the sheet 5 is also reduced to F2 (<F1). Consequently the arms 26 rotate further in the direction –b in comparison with the case of larger roll diameter. Thus the arms 26 stop at a position where the rotating force thereof is balanced with the resistance, or at a position in contact with the stopper 136 if the rotating force is larger. In this the wrapping angle assumes a value $\theta_2$ larger than $\theta_1$ for the larger roll diameter.

Consequently, the wrapping angle of the sheet 5 on the curl correcting shaft 22 is smaller or larger respectively for a larger or smaller roll diameter, and a larger wrapping angle provides a higher curl correcting effect as the sheet 5 is more strongly bent in the direction opposite to that of the curl. In this manner the curl correcting effect becomes stronger as the curl gets stronger at smaller roll diameter.

The sheet 5 subjected to curl correction proceeds to the image recording, then is cut with the cutter 7 and is discharged by the discharge rollers 8.

On the other hand, the sheet 5 remaining in the main body 1 is retracted by a distance l corresponding to the distance between the cutter 7 and the recording means 6, in order to avoid blank area at the leading end of the sheet in the next recording operation. For this purpose the motor is rotated in the reverse direction by a predetermined amount. The rotation of the motor is transmitted not only to the platen roller 6*a* but also to the clutch flange 28 through the spring clutch 130 in the aforementioned locked state, thereby rotating the arms 26 in the direction b.

In this state, as shown in FIGS. 14 and 18, the arms 26 are subjected to a tension, exerted by the spring 135, in a direction to hinder said rotation. Consequently, the motor 20 in this embodiment has a driving force for reverse rotation larger than the rotating force of the tension of the spring 135 on the arms 26.

Thus, when the motor 20 is reversed for retracting the sheet 5, the arms 26 rotate in the direction b, thereby being separated from the sheet 5. In this state, the engaging part 30*a* of the spring clutch 30 rotates substantially integrally with the arms 26 (FIGS. 18A→18B→18C), and the spring clutch 130 is loosened as the clutch gear 29 rotates while the engaging part 130*a* is in contact with the stopper 137. Consequently the clutch gear 29 rotates idly with respect to the clutch flange 28, and the arms 26 returns to and stop at the initial position.

In the initial position, the guide shaft 23 does not block the aperture of the roll holder 4, nor does it interfere with the curl correcting shaft 22 at the opening of the cover member 2. More specifically, in this position, the engaging part 30*a* of the spring clutch 30 is in contact with the stopper 137. In this state, since the guide shaft 23 is separated from the sheet 5, an inverse curl is not given thereto even if the standby state is prolonged.

In the following there will be explained a fourth embodiment in which the tension of the spring 135 of the third embodiment is made variable.

Figure 19A:
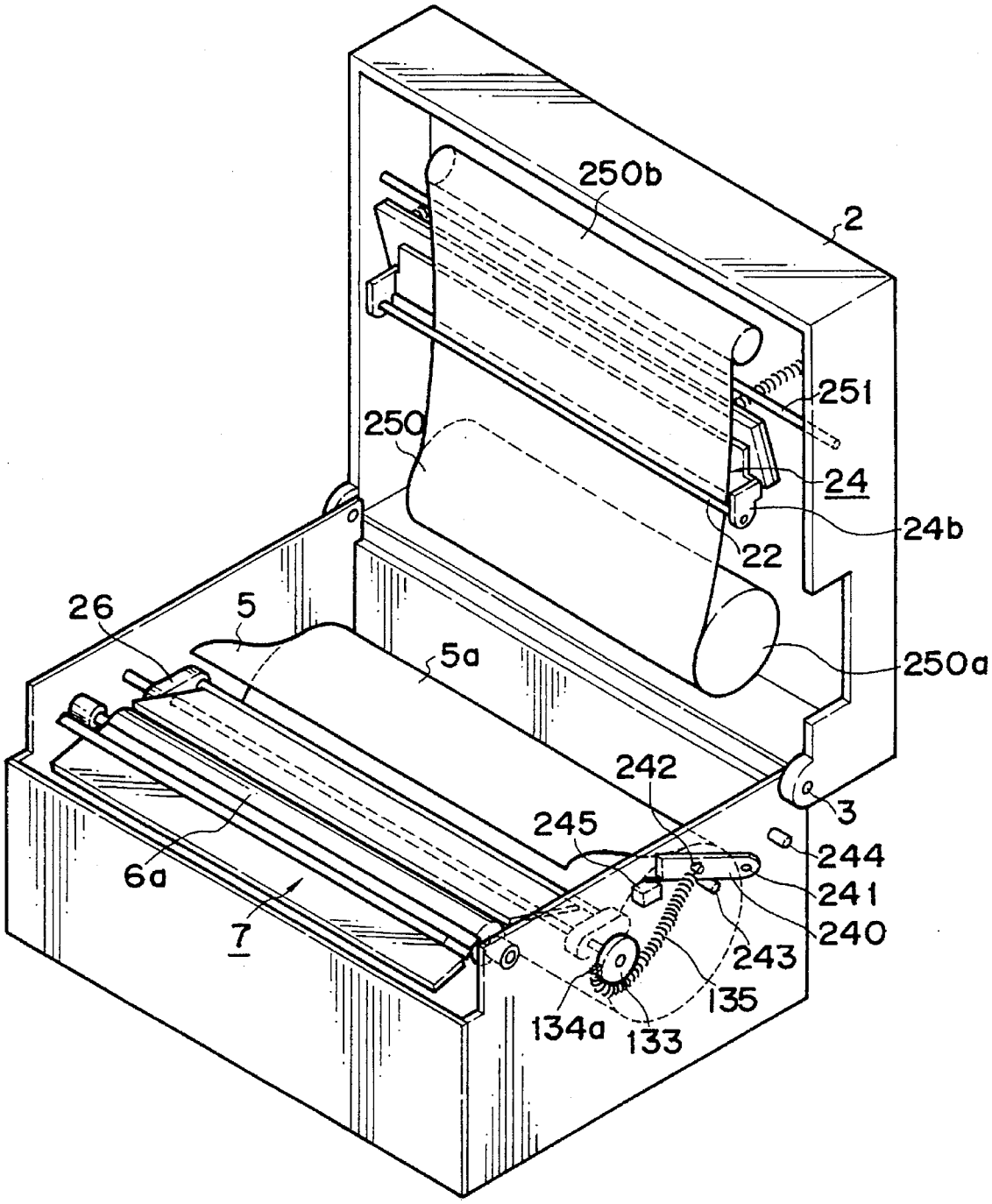
FIGS. 19A to 19D and 20 are views of a facsimile apparatus constituting a fourth embodiment.
Figure 19B:
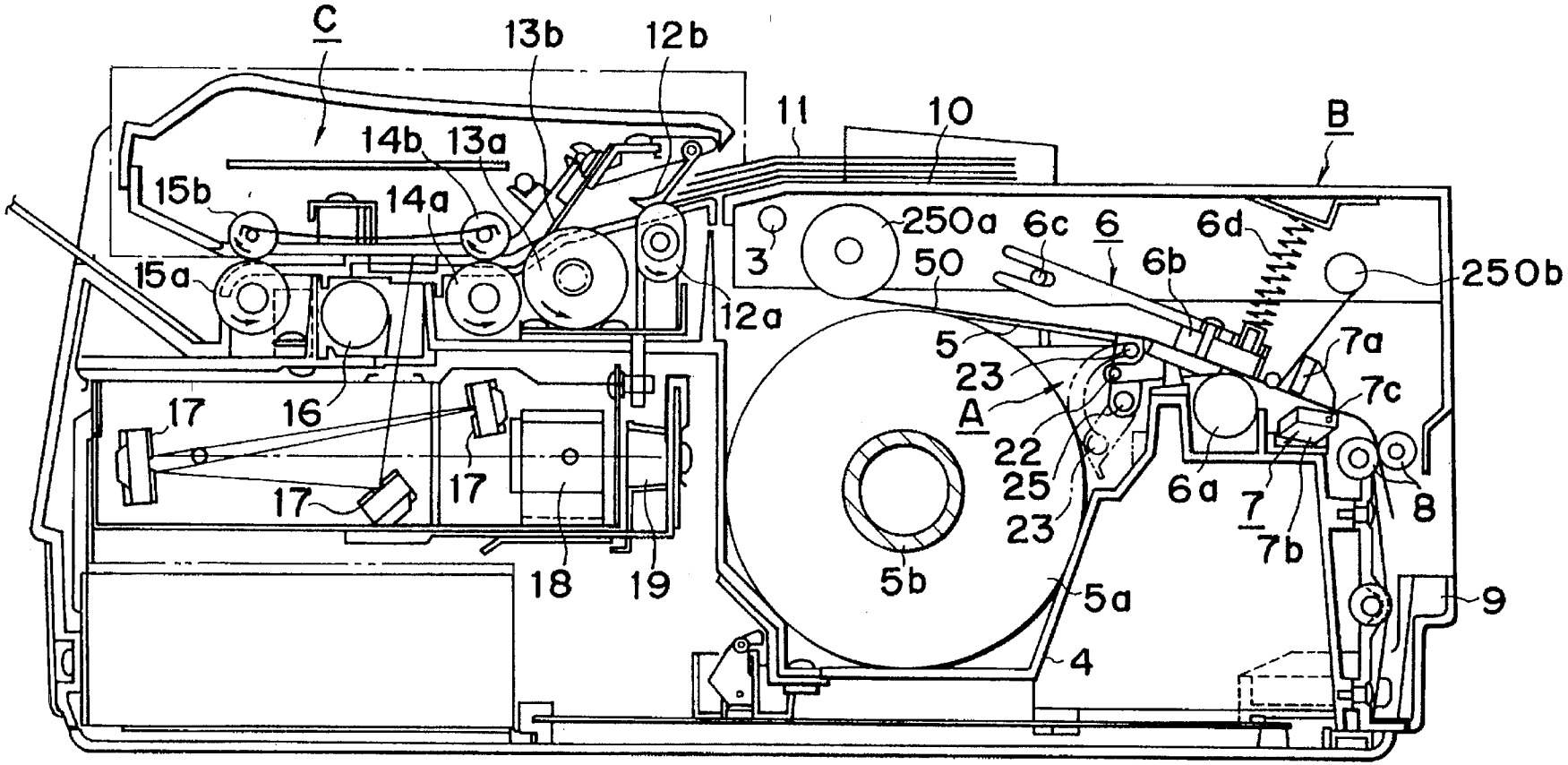
Figure 19C:
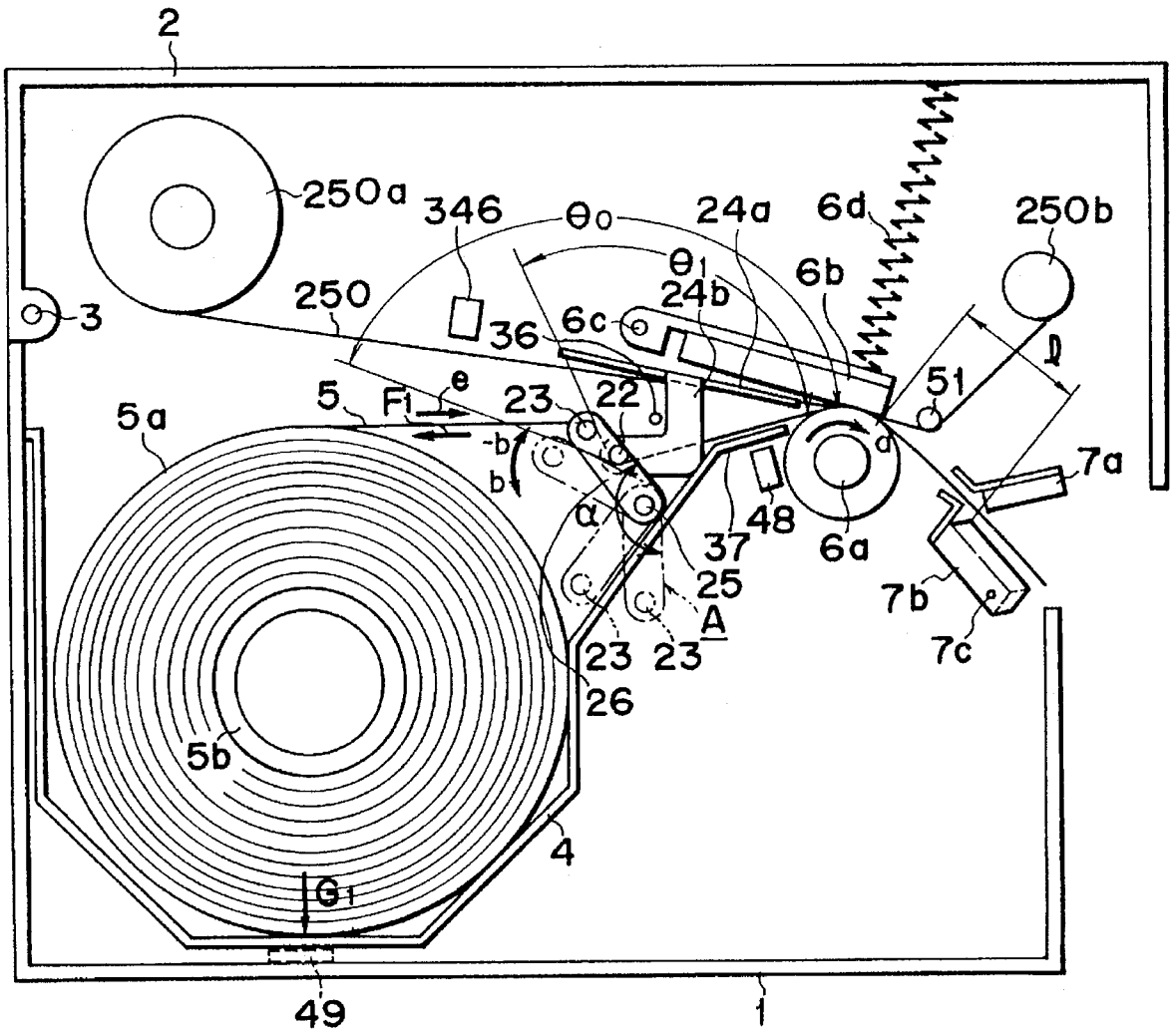
Figure 19D:
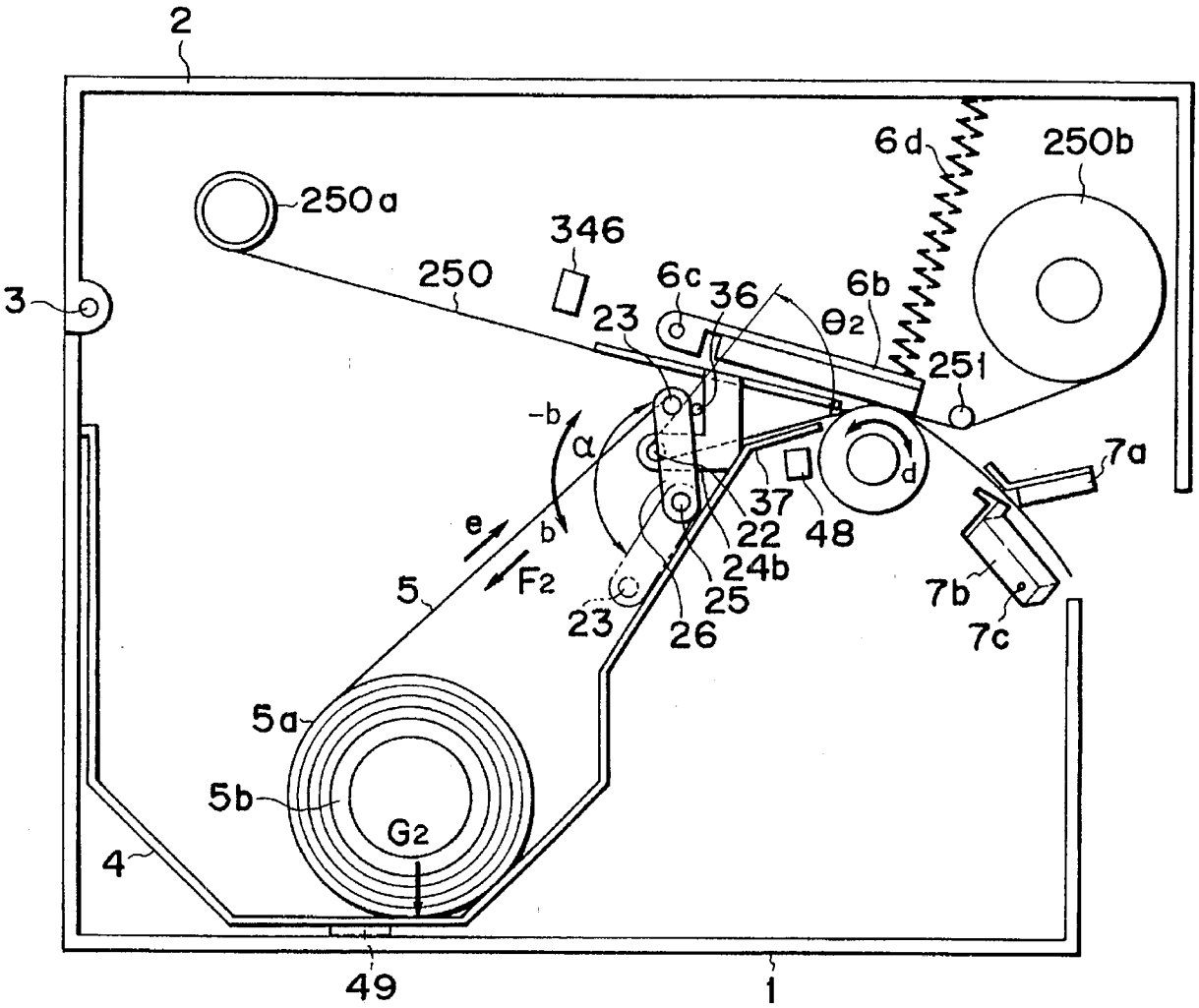
Figure 20:
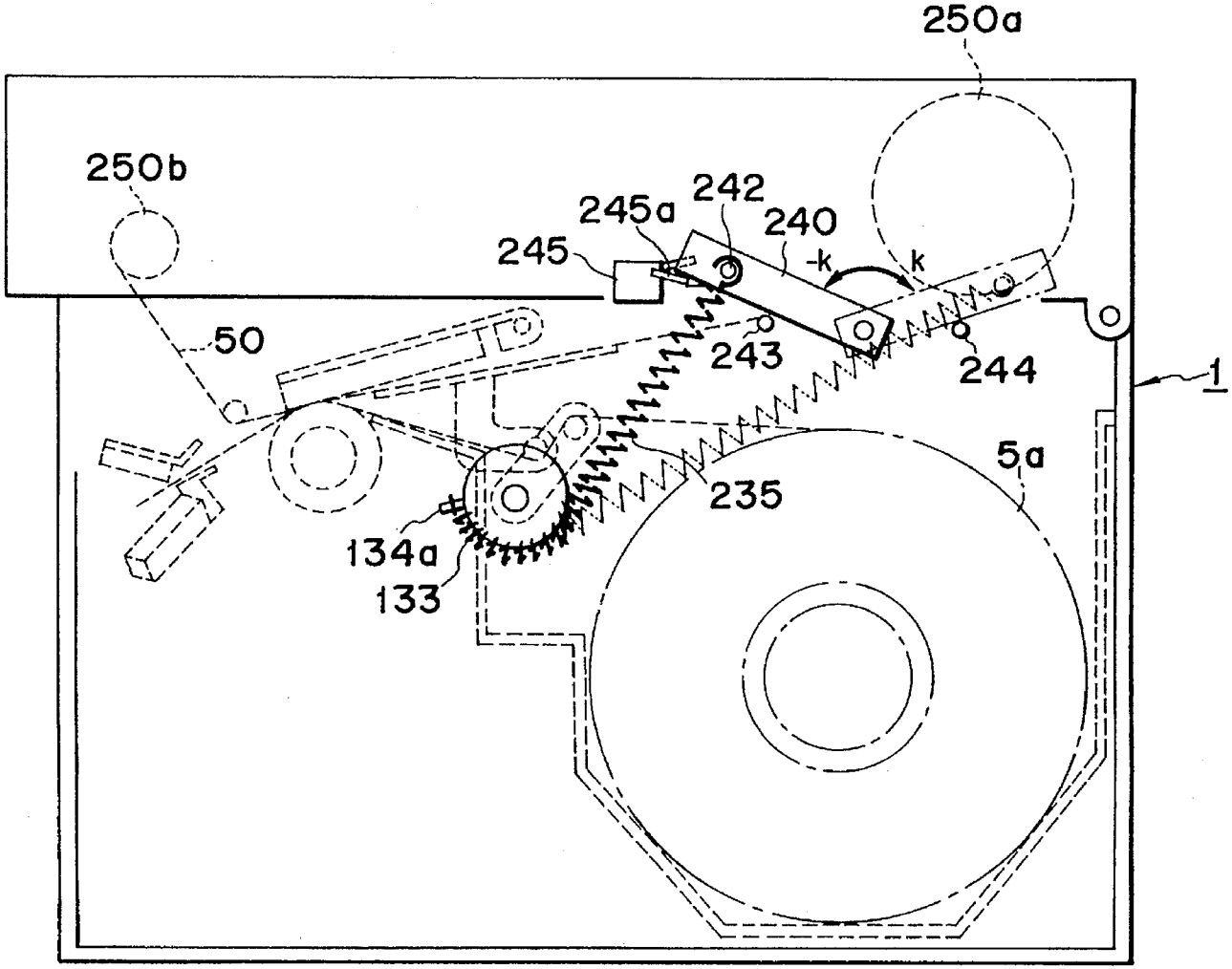

As shown in FIGS. 19 and 20, a switch lever 240 is rotatably provided by a pin 241 on a lateral face of the main body 1, on which the pulley 133 is positioned. Stoppers 243, 244 are provided for limiting the rotating range of said lever.

Now reference is made to FIG. 19 for explaining the entire structure.

The recording unit B has a main body 1 and a cover member 2 openably linked thereto by a shaft 3, and cover member 2 can be engaged with the main body 1 by a click mechanism (not shown). On the bottom side of cover member 2 there is mounted a feed roll 250*a* of an ink sheet 250 consisting of a substrate film such as polyester film coated with thermotransferrable ink, and a takeup roller 250*b*. In the far side of the main body there is provided a roll holder 4, in which loaded is a roll 5*a* of a sheet 5 consisting of plain paper. Ink sheet 250 and the sheet 5 are advanced by the rotation of a platen roller 6*a*. The curl of the sheet 5 is corrected in a curl correcting mechanism A, by bending in a direction opposite to that of the curl.

An image is recorded on the sheet 5 by fusing the ink of the ink sheet 250 and transferring it onto the sheet 5 in the recording means 5. After image recording the sheet 5 is cut by the cutter 7 and discharged onto a stacker 9 by discharge rollers 8. In sheet 250 is separated from the sheet 5 by a separating shaft 25*a* before reaching the cutter 7, and is wound by the takeup roller 250*b*. The feed roller 250*a* and the takeup roller 250*b* are driven with tension on the ink sheet, in order to avoid slack therein, by a driving system 250*c* (cf. FIG. 22).

The recording head 6*b* heats the ink sheet 250 according to the image signal, thereby fusing ink of the ink sheet and transferring said ink onto the sheet 5, thus forming an image thereon, and is pressed to the platen roller 6*a* across the sheet 5 and the ink sheet 250. More specifically the recording head 6*b* is rotatably mounted, by a shaft 6*c*, on the cover member 2, and presses the platen roller 6*a* by a compression spring 6*d* when the cover member is closed. Thus the sheet 5 and the ink sheet 250 are advanced by the rotation of the platen roller 6*a* while the sheets are pinched between the platen roller 6*a* and the recording head 6*b*.

The recording head 6*b* in the present embodiment is a so-called line thermal head, having, on a face in contact with the ink sheet 250, plural heat-generating elements arranged in the transverse direction of the ink sheet 250. Electric currents corresponding to image signal are supplied to the heat-generating elements $6b_1$ to selectively heat the ink sheet 250, thereby fusing the ink in the heated portions and transferring ink onto the sheet 5, thus recording an image.

On the rotating end of the switch lever 240 there is provided a hook 242, on which engaged is the other end of tension spring 135. Thus said spring 135 is provided under tension between said hooks 134*a* and 142, whereby the pulley 133 is constantly biased in a direction f shown in FIG. 14, namely a direction for increasing the curl correcting effect by the guide shaft 23.

Switch lever 240 is provided for switching the tension of the tension spring 135. In the solid-lined position in contact with the stopper 243 as shown in FIG. 20, the tension of the spring 135 is small as the distance between the hooks 134*a*, 242 is short. Consequently the torque of the pulley 133 in the direction f is weak, and the curl correcting effect is weak.

On the other hand, in the chain-lined position in contact with the stopper 244, as shown in FIG. 20, the spring 135 is more extended and has a stronger tension, as the distance between the hooks 134*a* and 242 is longer. Consequently the pulley 133 receives a stronger torque in the direction f, and the curl correcting effect becomes stronger.

In this manner the rotation of the switch lever 240 allows a change of the tension of the spring 135, thereby increasing or decreasing the curl correcting effect.

In the movement k of the switch lever 240 from the solid-lined position in FIG. 20 to the chain-lined position, the spring 135 is at first extended to increase the resistance to movement. However, when the lever 240 moves from a substantially vertical position to the side of the stopper 244 (when the central line of the spring 135 passes through the pin 241 toward the stopper 244), the force of the spring 135 tends to rotate the lever 240 in the direction k, so that the lever 240 rotates spontaneously to the position of the stopper 244.

In the present embodiment, the lever 240 is placed in the chain-lined position, since the sheet 5 is composed of plain paper having a strong curling tendency. Thus the tension of the spring 135 (or torque on the arms 26) is increased, so that, even for a large diameter of the roll 5*a* as shown in FIG. 19C, the amount of rotation of the arms 26 increases and the angle of the sheet 5 over the curl correcting shaft 22 becomes smaller than $\theta_1$, thus intensifying the curl correcting effect.

When the tension of the spring 135 is increased by the switch lever 240, the curl correcting effect increases with the decrease of the roll 5*a* in diameter as shown in FIG. 19D, but the minimum angle of the sheet 5 over the curl correcting shaft 22 is determined by the position of the stopper 136 and cannot become smaller than $\theta_2$. The position of said stopper 136 has therefore to be changed to obtain a further degree of curl correcting effect.

When the ink sheet 250 is removed and the plain recording sheet is replaced by thermal recording sheet having less of a curling tendency, the switch lever 240 is moved to the solid-lined position in FIG. 20. Since the torque on the arms 26 is reduced in this state, the arms 26 rotates less in the direction −b even for a small roll diameter, whereby the angle of the sheet 5 over the curl correcting shaft 22 becomes larger than $\theta_2$ and the curl correcting effect is weakened. As explained in the foregoing, the rotating operation of the switch lever 240 allows to regulate the level of curl correcting effect, thereby achieving appropriate curl correction according to the kind, thickness etc. of the sheet 5.

Figure 21A:
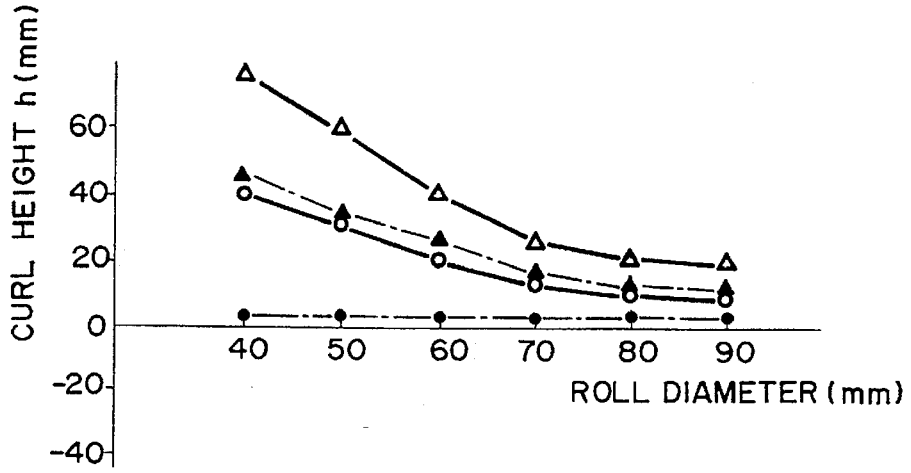
FIGS. 21A to 21C are charts showing the results of curl correction.
Figure 21B:
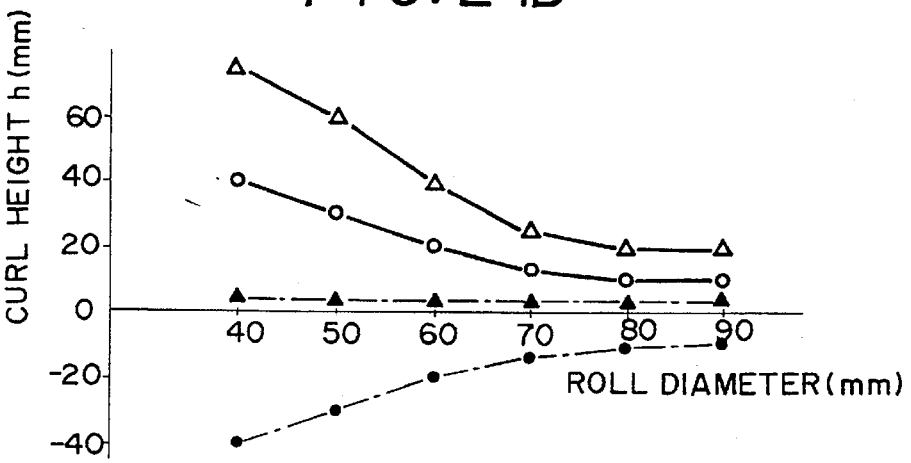
Figure 21C:
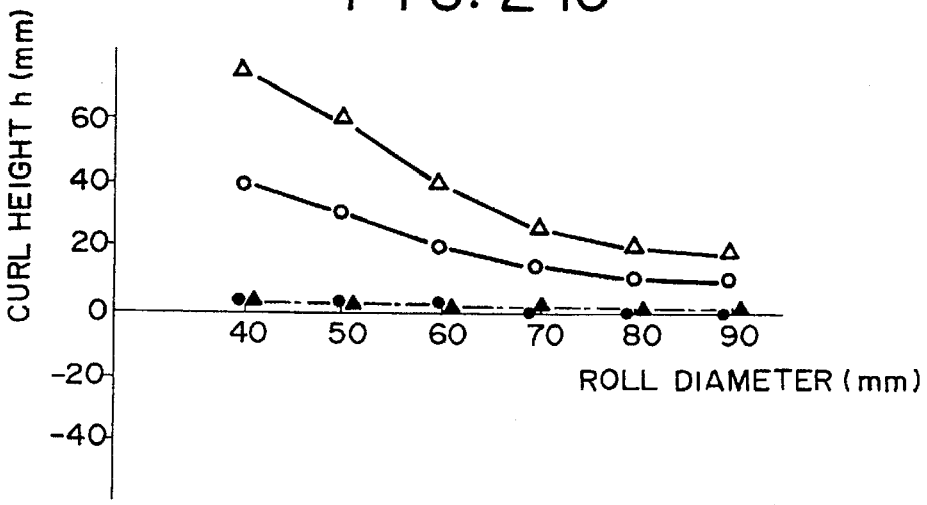

FIGS. 21A to 21C show experimental results of curl correction of the sheet 5 with the above-explained curl correcting mechanism A.

The sheet 5 used in these experiments consists of a plain paper sheet of a thickness of 85 μm and a length of 100 m, or a thermal recording sheet of a thickness of 65 μm and a length of 100 m. The curl correcting shaft 22 and the guide shaft 23 had an outer diameter of 4 mm, and the moving radius of the guide shaft 23 was 13 mm. The torque of the arms 26 was set at 1.5 or 1 kg·cm respectively for the plain paper and the thermal recording paper. The curl height h was measured by cutting the sheet into a length of A4 size.

These charts show the curl height h (mm) on the ordinate, as a function of roll diameter (mm) on the abscissa. White triangles indicate the curl height of the plain paper without curl correction; while circles indicate the curl height of the thermal recording sheet without curl correction; black triangles indicate the curl height of the plain paper after curl correction; and black circles indicate the curl height of the thermal recording sheet after curl correction.

FIG. 21A shows the results of curl correction on the thermal recording sheet and on the plain paper, when the switch lever 240 is placed at the solid-lined position in FIG. 20, corresponding to the torque of 1 kg·cm on the arms 26 designed for the thermal recording sheet. As shown in this chart, the curl correction was insufficient for the plain paper though it is appropriate for the thermal recording sheet.

FIG. 21B shows the results of curl correction on both recording sheets, with the switch lever 240 at the chain-lined position in FIG. 20, corresponding to the torque of 1.5 kg·cm for the plain paper. Though the curl correction was appropriate for the plain paper, that for the thermal recording sheet was excessive and resulted in inverse curling.

FIG. 21C shows the result of curl correction with switching of the lever 240, at the solid-line position with the torque on the arms 26 of 1 kg·cm for the thermal recording sheet and at the chain-lined position with the torque on the arms 26 of 1.5 kg·cm for the plain paper. As shown in this chart, appropriate curl correction was obtained both for the thermal recording sheet and for the plain paper.

Also as shown in FIGS. 21A to 21C, the curl height h of the sheet 5 is smaller or larger as the roll diameter is respectively larger or smaller. The sheet eventually becomes rounded when the roll diameter becomes equal to or smaller than about 40 mm. Such curl can be eliminated by the above-explained mechanism.

As explained in the foregoing, the curl correcting mechanism A is capable of appropriately correcting the curl, by regulating the curl correcting effect according to the level of curl, through the balance between the tension on the sheet and the torque on the arms 26. Arms 26 are biased by the tension spring 135 of which tension is regulable by the switch lever 240, so that appropriate curl correction can be achieved according to the kind, thickness etc. of the sheet 5. Also the rotation of the motor 20 in the direction c is transmitted to the platen roller 6*a* but not to the arms 26. Consequently, the motor 20 is not given a load for moving the arms 26 at the recording operation. Thus the precision of transportation can be improved and the image recording of high quality can be achieved.

In the present embodiment, a microswitch 45 to be actuated by the switch lever 240 is provided in the vicinity thereof, as shown in FIGS. 19 and 20. Microswitch 45 detects the position of lever 240, and the output P2 of the motor 20 at the reverse rotation can be switched according to the detection. More specifically, when the microswitch 45 is on, the spring 135 has the lower tension to exert the lower torque on the arms 26, so that the motor power $P_2$ at the reverse rotation is switched to a smaller output $P_{2a}$ ($>P_1$) When the microswitch 45 is off, the spring 135 has the higher tension to exert the higher torque on the arms 26, so that the motor power $P_2$ is switched to a larger output $P_{2b}$ ($<P_{2a}$).

Figure 22:
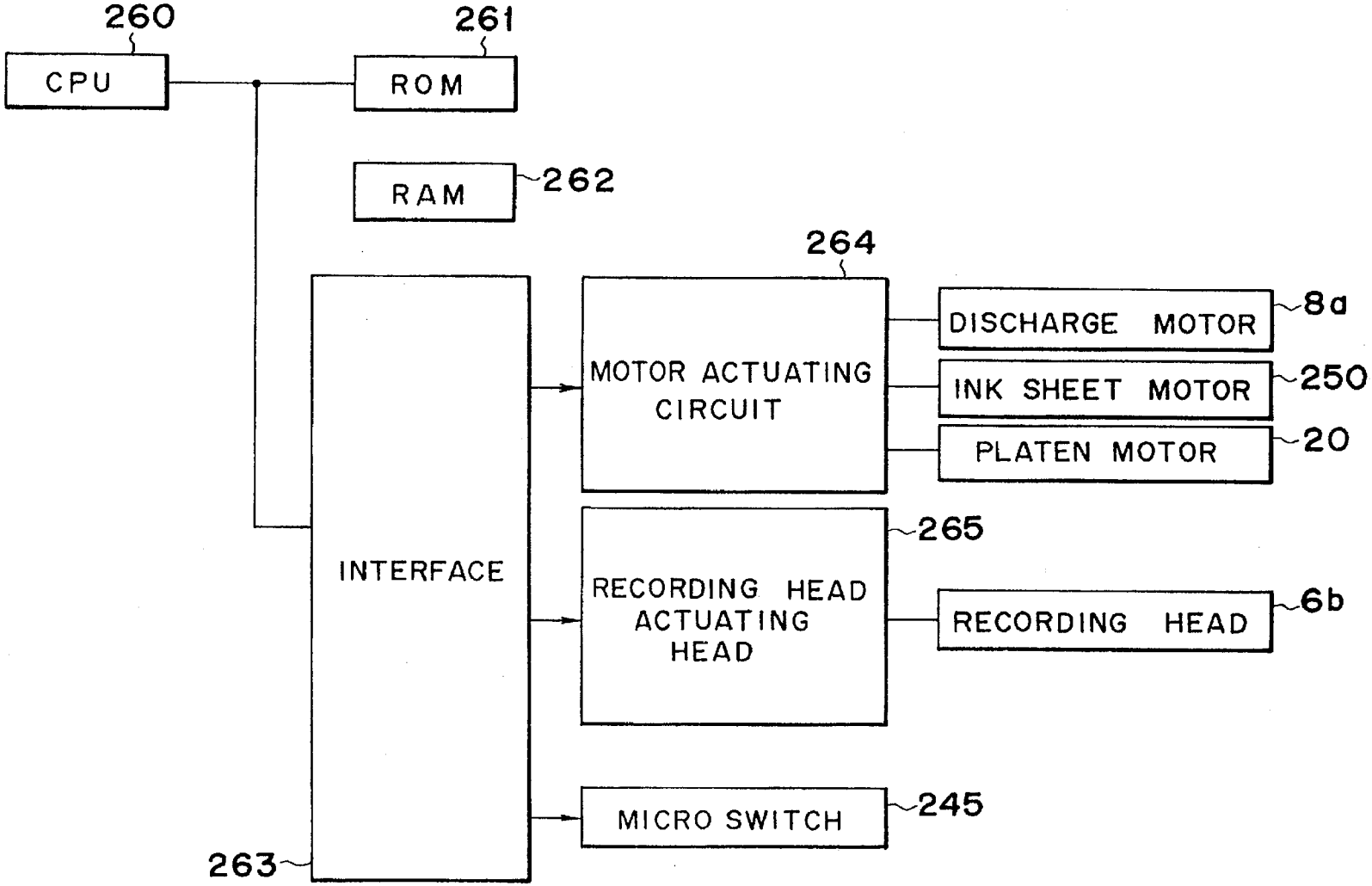
FIG. 22 is a block diagram of a control system.

FIG. 22 is a block diagram of the control system of the entire recording unit B, including the output control for the platen motor 20 at the reverse rotation, wherein provided are a CPU 260 for controlling the entire system, a ROM 261, a RAM 262, and an interface 263. Interface 263 is connected to a motor actuating circuit 264 for the platen motor 20, ink sheet motor 250*c* and discharge motor 8*a*,; a recording head actuating circuit 265 for the recording head 6*b*; and the microswitch 245 explained above.

Figure 23A:
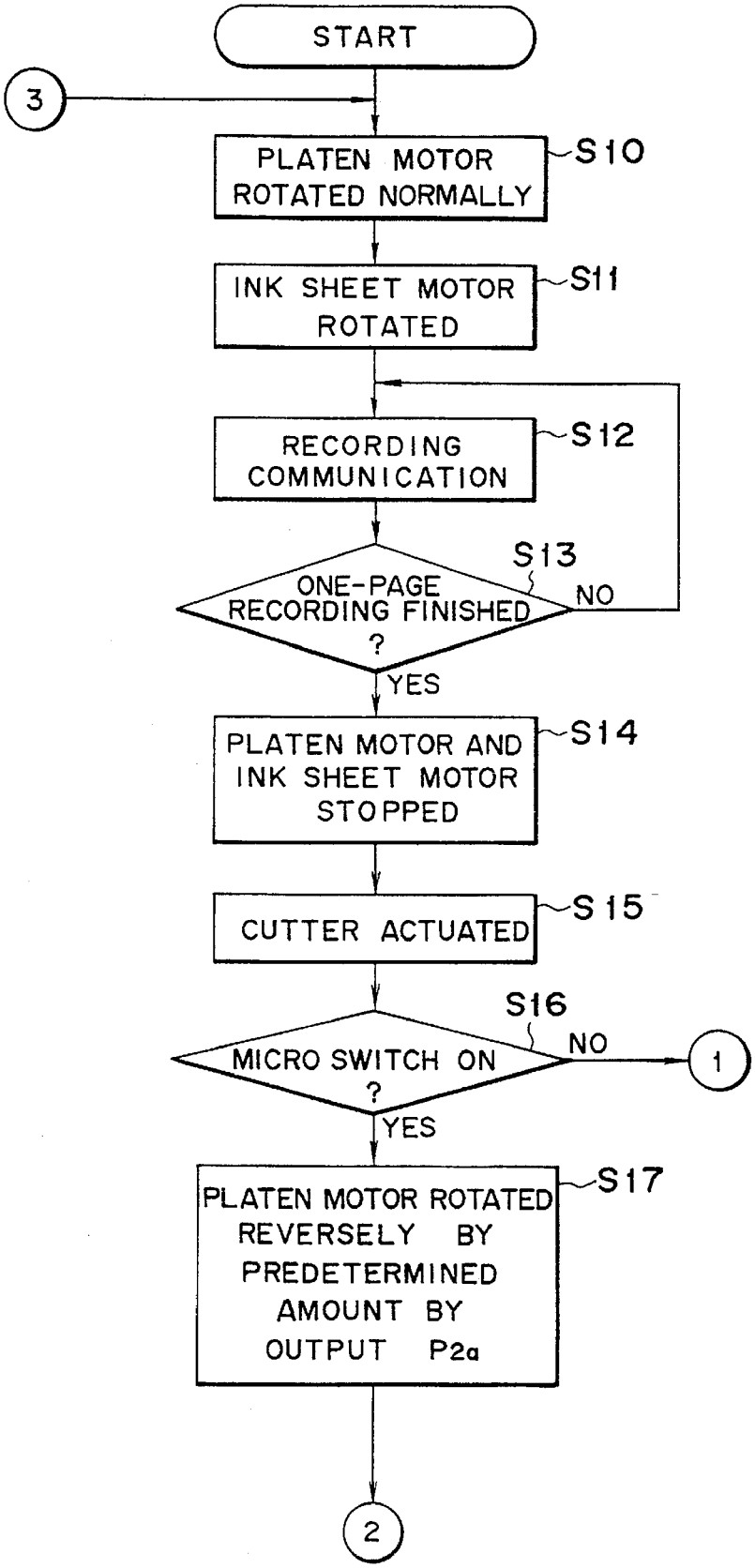
FIG. 23A and 23B are flow charts of a control sequence.
Figure 23B:
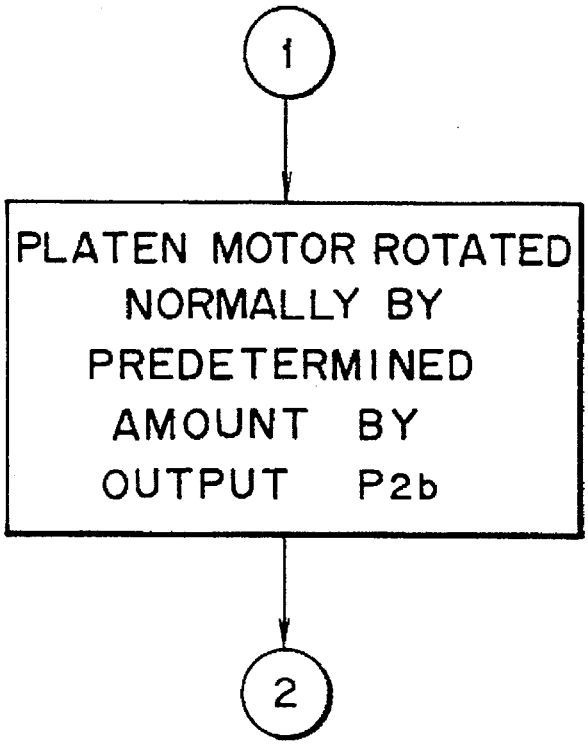
Figure 23B:
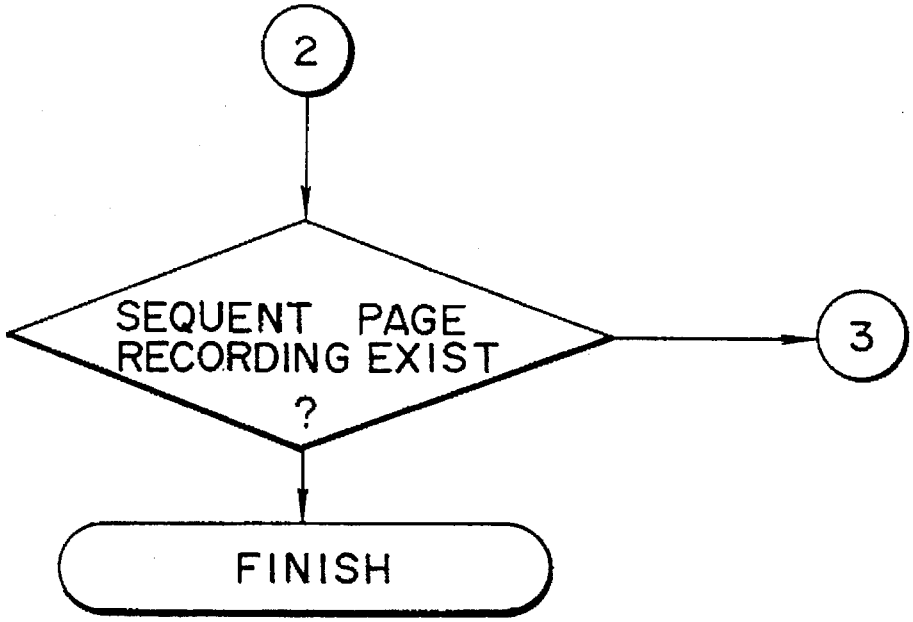

The ROM 261 stores a control program corresponding to a flow chart shown in FIG. 23, and the CPU 260 control the motor actuating circuit 264 and the recording head actuating circuit 265 according to said program. Also in response to a signal supplied from the microswitch 245 through the interface 263, the CPU 260 switches the output of the motor 20 to $P_{2a}$ or $P_{2b}$ through the motor actuating circuit 264.

In the recording operation of the recording unit B, at a step S10 rotates the platen motor 20 in the forward direction, and a step S11 activates the ink sheet motor 250*c*. Then a step S12 energizes the recording 6*c*. Then a step S13 discriminates whether the recording of a page has been completed, and, if completed, a step S14 deactivates the platen motor 20 and the ink sheet motor 250*c* when the rear end of the recorded image reaches the position of the cutter 7. Then a step S15 activates the cutter 7 to cut the sheet 5.

A next step S16 discriminates the state of the microswitch 245, and, if it is on, a step S17 reverses the platen motor 20 with the smaller power $P_{2a}$, thereby retracting the leading end of the sheet 5 from the position of the cutter 7 to the position of the recording means 6. If the microswitch 245 is off, a step S18 reverses the platen motor 20 with the larger power $P_{2b}$ for retracting the sheet in the same manner. In this state the arms 26 are returned to the position shown in FIG. 18C. Consequently the cover member 2 can be opened smoothly, without interference of the guide shaft 23 with the curl correcting shaft 22, for example for the loading of the roll 5*a*.

Then a step S19 discriminates the command for the recording of next page, and if the command is present, the sequence returns to the step S10 to repeat the above-explained sequence. If the command is absent, the operation of the recording system B is terminated.

As explained in the foregoing, the present embodiment is capable of appropriate curl correction according to the level of curling and the kind, thickness etc. of the sheet, and is also capable of precise sheet transportation since the motor 20 is only required to rotate the platen roller 6*a* at the recording operation. Also it enables easy replacement of the sheet roll 5*a*.

In the following there will be explained a fifth embodiment in which the switch lever in the 4th embodiment is automatically switched.

Figure 24:
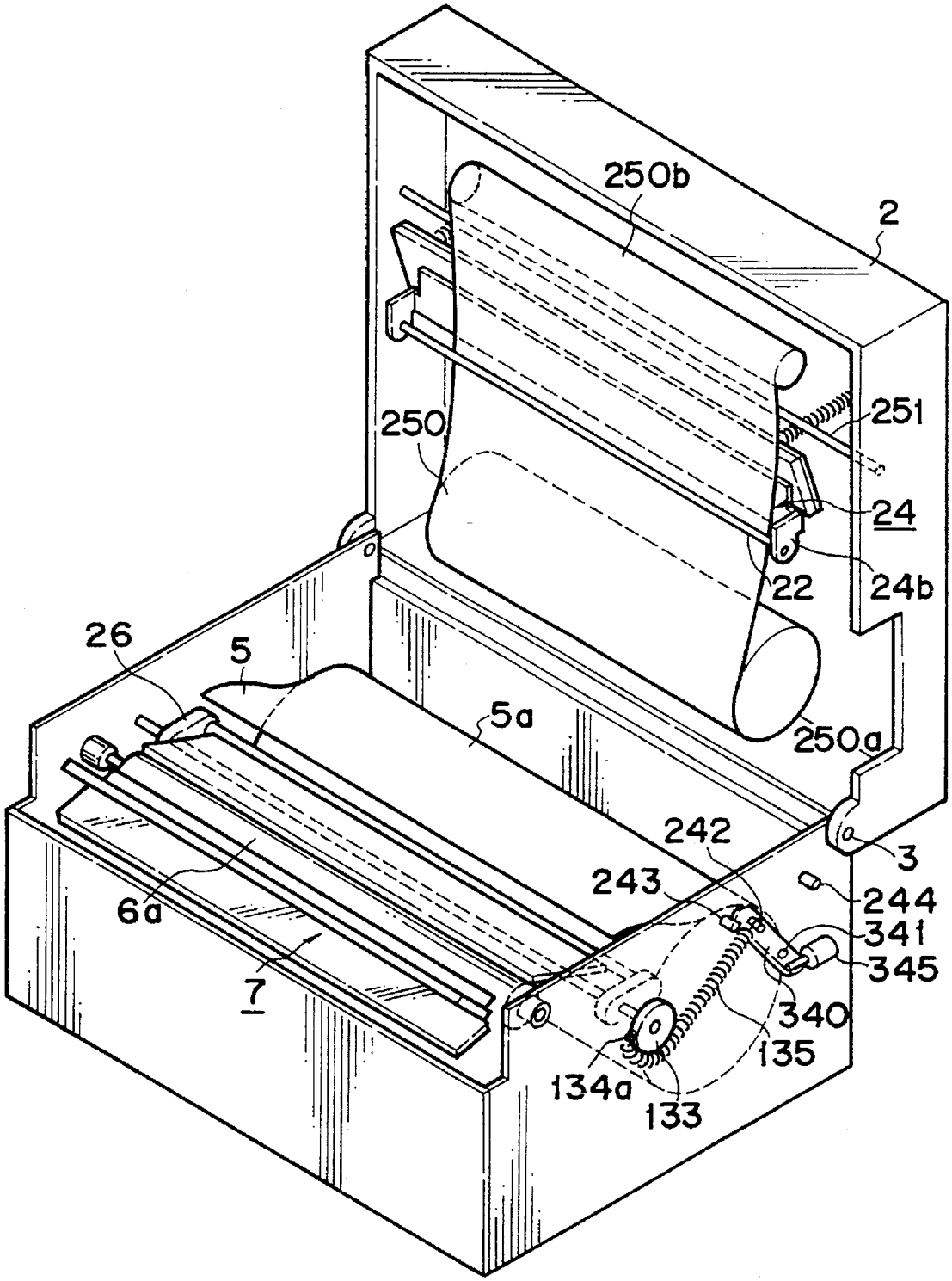
FIGS. 24 and 25 are respectively a perspective view and an elevation view of a facsimile apparatus constituting a fifth embodiment of the invention.
Figure 25:
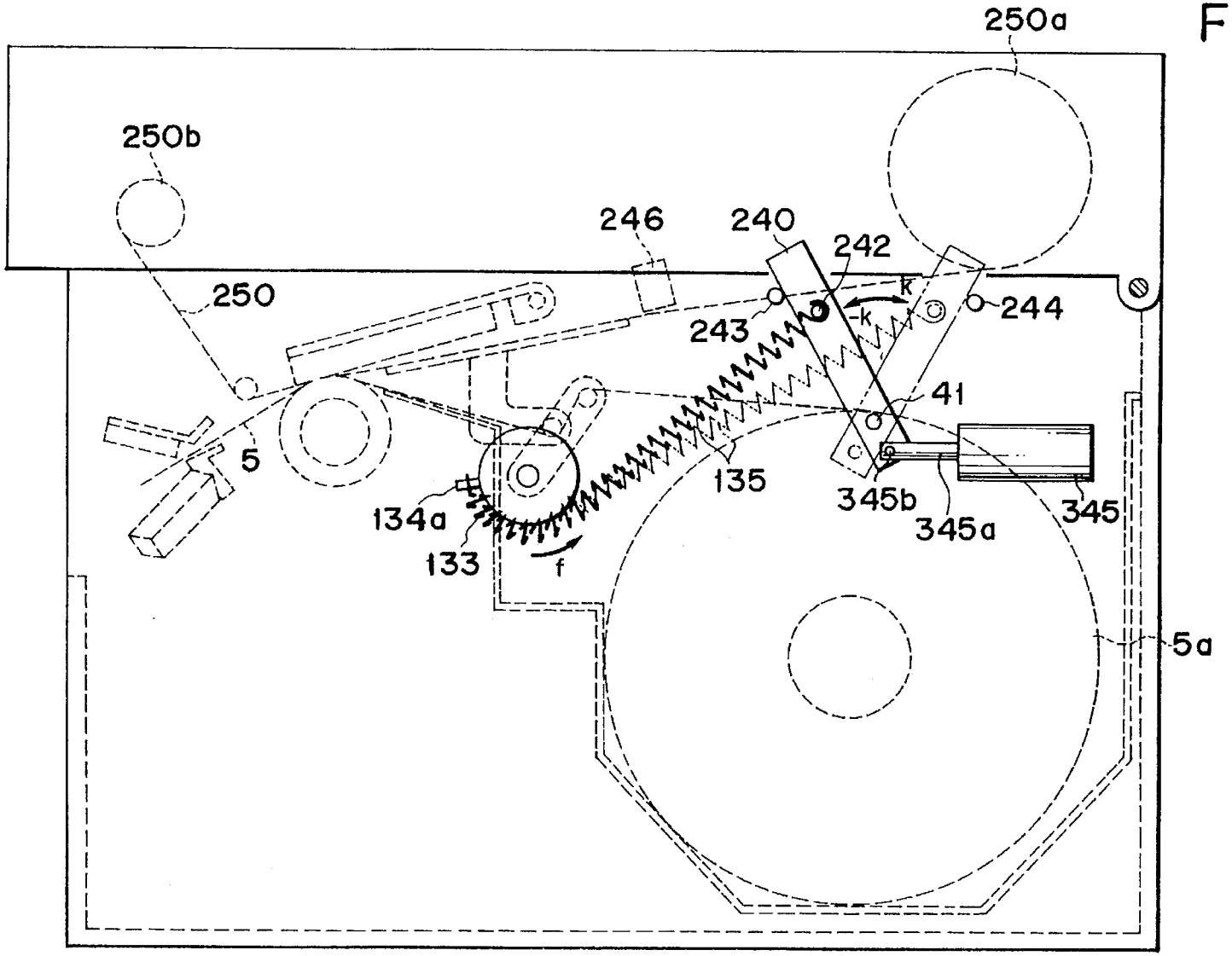

As shown in FIGS. 24 and 25, a switch lever 240 is rotatably provided by a pin 24*a* on a lateral face of the main body 1, on which the pulley 133 is positioned. Also provided are drive means 345 for actuating switch lever 240, and stoppers 243, 244 for limiting the rotating range of lever 240.

On the rotating end of the switch lever 240 there is provided a hook 242, on which engaged is the other end of tension spring 135. Thus said spring 135 is provided under a tension between said hooks 242 and 134*a*, whereby the pulley 133 is constantly biased in a direction f in FIG. 25, namely a direction to increase the curl correcting effect by the guide shaft 23.

The other end of the switch lever 240 is connected, through a pin 345*b*, to a plunger 345*a* of the drive means 345. Thus the switch lever 240 can be placed at the solid-lined position or the chain-lined position in FIG. 25, by advancing or retracting the plunger 345*a* by the drive means 345. Switch lever 240 changes the tension of the spring 135. In the solid-lined position in contact with the stopper 243, as shown in FIG. 25, the spring 135 is extended less because of the shorter distance between the hooks 134*a* and 242, whereby the tension is lower and the torque on the pulley 133 in the direction f is weaker. Consequently the curl correcting effect is weaker.

For intensifying the curl correcting effect, the drive means 345 is activated to advance the plunger 345*a*, thereby rotating the switch lever 240 in the direction k shown in FIG. 25. The lever 240 rotates to the position of the stopper 244 and stops in contact therewith (chain-lined position in FIG. 25). In this position the spring 135 is extended more because of the longer distance between the hooks 134*a* and 242, whereby the tension is higher and the torque on the pulley 133 in the direction f is stronger. Consequently the curl correcting effect becomes stronger.

For reducing the curl correcting effect from this state, the drive means is activated to retract the plunger 245*a*, thereby rotating the switch lever 240 in the direction −k. In this manner the rotation of the switch lever 240 by the drive means 245 allows to regulate the tension of the spring 135, thereby intensifying or reducing the curl correcting effect.

In the following there will be explained detecting means for detecting the presence of the ink sheet 250, and control means for controlling the switch means in response to the signal from the detecting means.

As shown in FIG. 19C, an ink sheet sensor 346 is provided as detecting means, in the vicinity of the path of the ink sheet 350. The ink sheet sensor is composed for example of a photosensor, which projects light toward the ink sheet 350 and receives reflected light to detect the presence or absence of the ink sheet 350.

Figure 26:
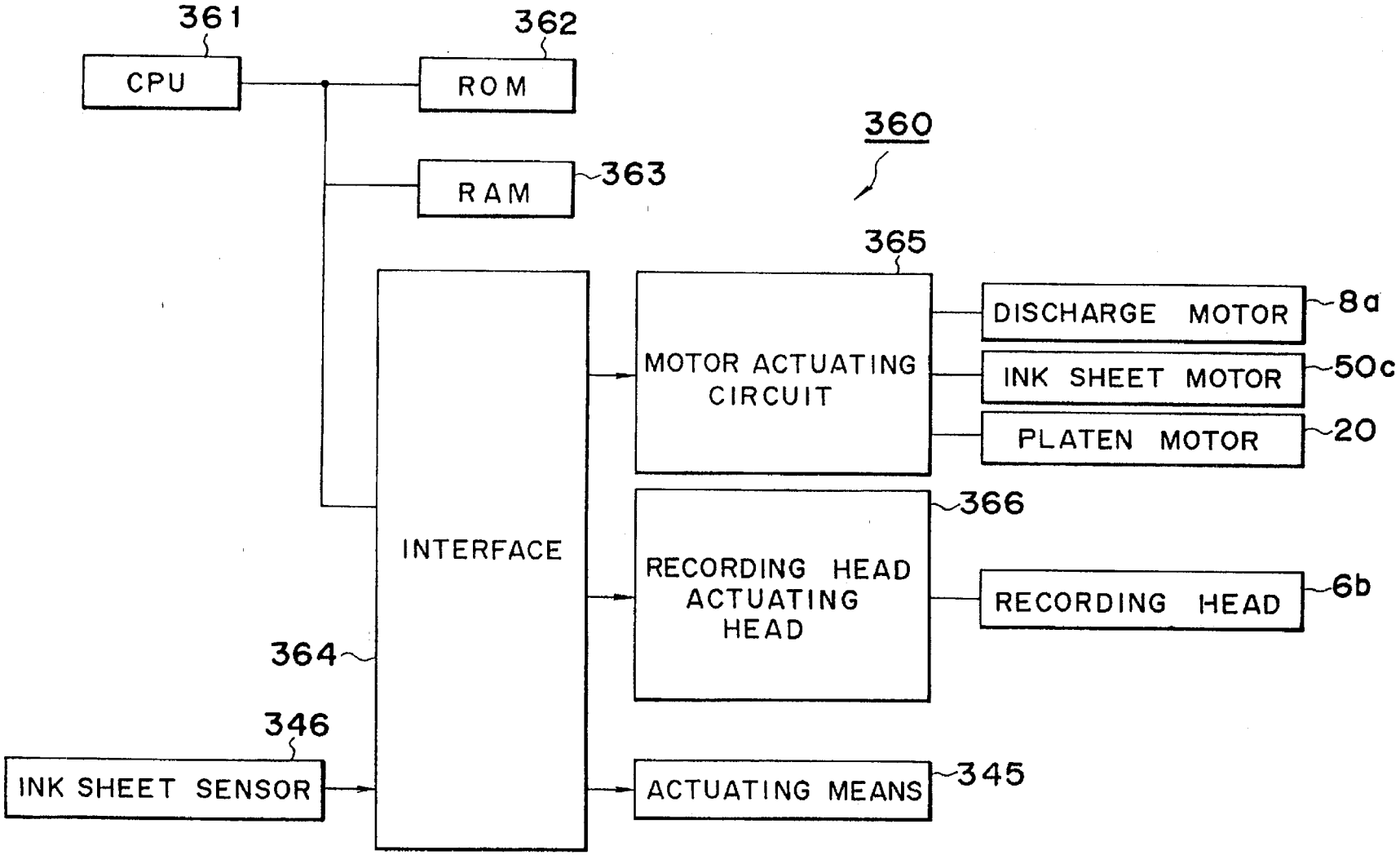
FIG. 26 is a block diagram of the control system thereof.

The output of the ink sheet sensor 346 is supplied to control means 360 shown in FIG. 26. The control means 360 is composed of a CPU 361 for controlling the entire system, a ROM 362 storing the control program, a RAM 363 and an interface 364, and serves to control the platen motor 20, recording head 6*b* etc. in addition to the drive means 345 for rotating the switch lever 240 in response to the detection signal from the ink sheet sensor 346.

The interface is connected to a motor actuating circuit 365 for said platen motor 20, ink sheet motor 250*c* and discharge motor 8*a*; a heat actuating circuit 366 for recording head 6*b*; drive means 345; and ink sheet sensor 346.

Figure 27:
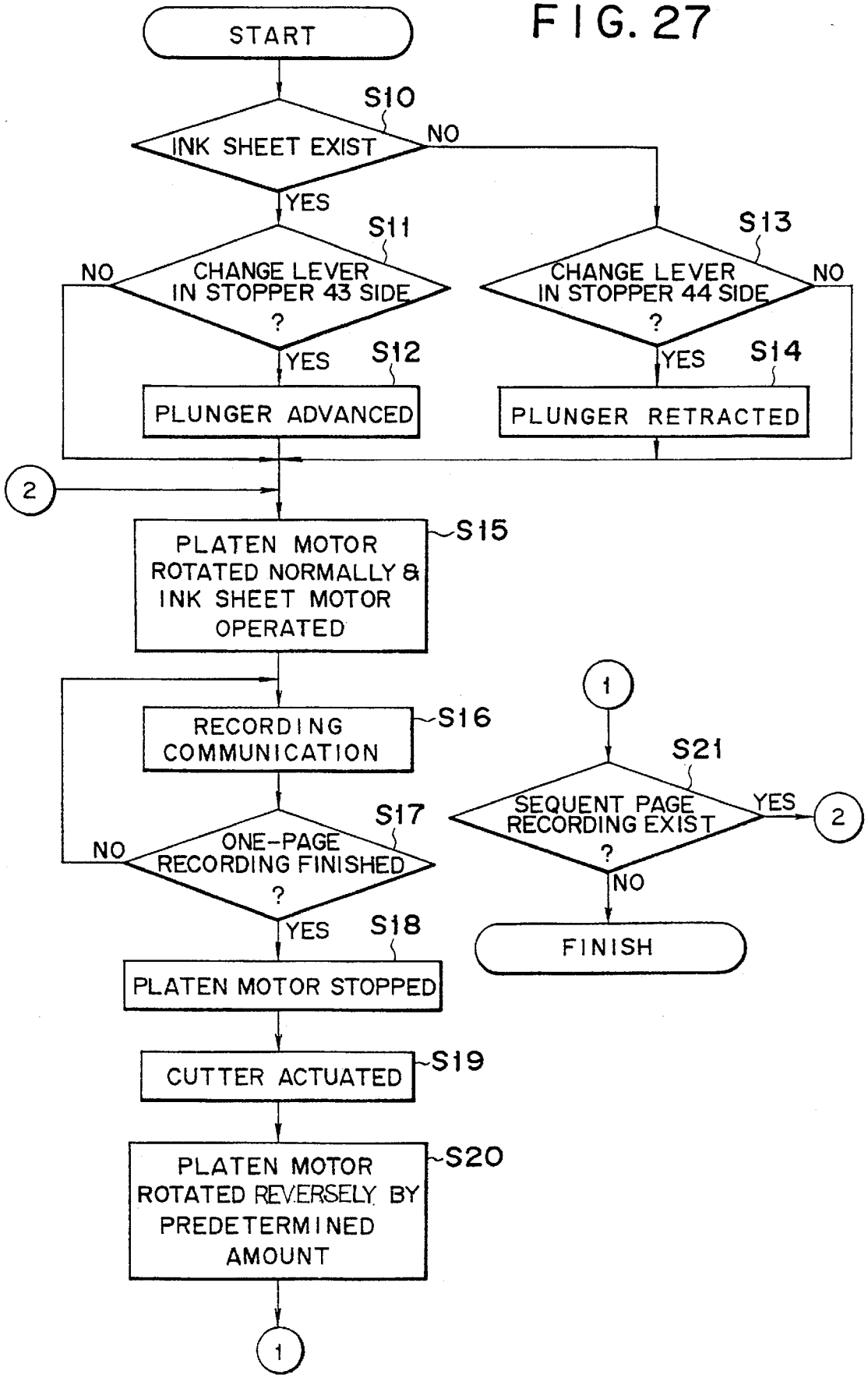
FIG. 27 is a flow chart of the control sequence thereof.

The ROM 362 stores a control program corresponding to the flow chart shown in FIG. 27, and the CPU 361 controls the motor actuating circuit 364 and the recording head actuating circuit 365 according to program.

Also in response to a signal indicating the presence or absence of the ink sheet, supplied from the ink sheet sensor 346 through the interface 364, the CPU 361 controls the drive means 345 to shift the switch lever 240 to the solid-lined position or the chain-lined position shown in FIG. 25. More specifically, at the recording operation of the recording unit B, at first a step S10 discriminates the presence or absence of the ink sheet 350, and if present, a step S11 discriminates whether the switch lever 240 is at the stopper 243.

If it is at the stopper 243, the drive means 345 is activated to advance the plunger 345*a* thereby shifting the switch lever 240 to the side of the stopper 244, for stronger curl correcting effect. Then the sequence proceeds to a step S15. On the other hand, if the switch lever 240 is not at the stopper 243, the sequence proceeds to the step S15 without activation of the drive means 345. Also if the step S10 identifies the absence of the ink sheet 350, a step S13 discriminates whether the switch lever 240 is at the side of the stopper 244.

If it is at the stopper 244, a step S14 activates the drive means 345 to retract the plunger 346*a* thereby shifting the lever 240 to the stopper 243 for weaker curl correcting effect, and the sequence proceeds to the step S15. If the lever 240 is not at the stopper 244, the sequence proceeds to the step S15 without activation of the drive means 345.

Then the step S15 rotates the platen motor 20 in the forward direction, and activates the ink sheet motor 50*c*, and a step S16 energizes the recording head 6*c*. Then a step S17 discriminates if the recording of a page has been completed, and if completed, a step S18 deactivates the platen motor 20 and the ink sheet motor 50*c* when the rear end of the recorded image reaches the position of the cutter 7. A next step S19 activates the cutter 7 to cut the sheet 5.

Then a step S20 reverses the platen motor 20 with a power corresponding to the presence or absence of the ink sheet 350 as will be explained later, thereby retracting the leading end of the sheet 5 from the position of the cutter 7 to the position of the recording means 6. In this state the arms 26 return to the position shown in FIG. 18C.

Then a step S21 discriminates the command for the recording of next page, and if the command is present, the sequence returns to the step S15 to repeat the above-explained procedure. In the absence of the command, the operation of the recording unit B is terminated.

When the sheet 5 is changed to the thermal recording sheet, the ink sheet 350 is removed. Consequently the ink sheet sensor sends a signal, indicating the absence of the ink sheet, to the CPU 36*a* through the interface 364. In response, the drive means 345 is controlled to shift the switch lever 240 to the solid-lined position shown in FIG. 25. Thus the torque on the arms 26 is reduced, so that the amount of rotation of the arms 26 in the direction −b is reduced even for a smaller roll diameter as shown in FIG. 6A. Therefore, the angle of the sheet 5 over the curl correcting shaft 22 becomes larger than $\theta_2$, and the curl correcting effect is weakened.

As explained in the foregoing, the rotation of the switch lever 240 by the drive means 345 allows to regulate the curl correcting effect, and appropriate curl correction can be achieved according to the kind, thickness etc. of the sheet 5.

Figure 28:
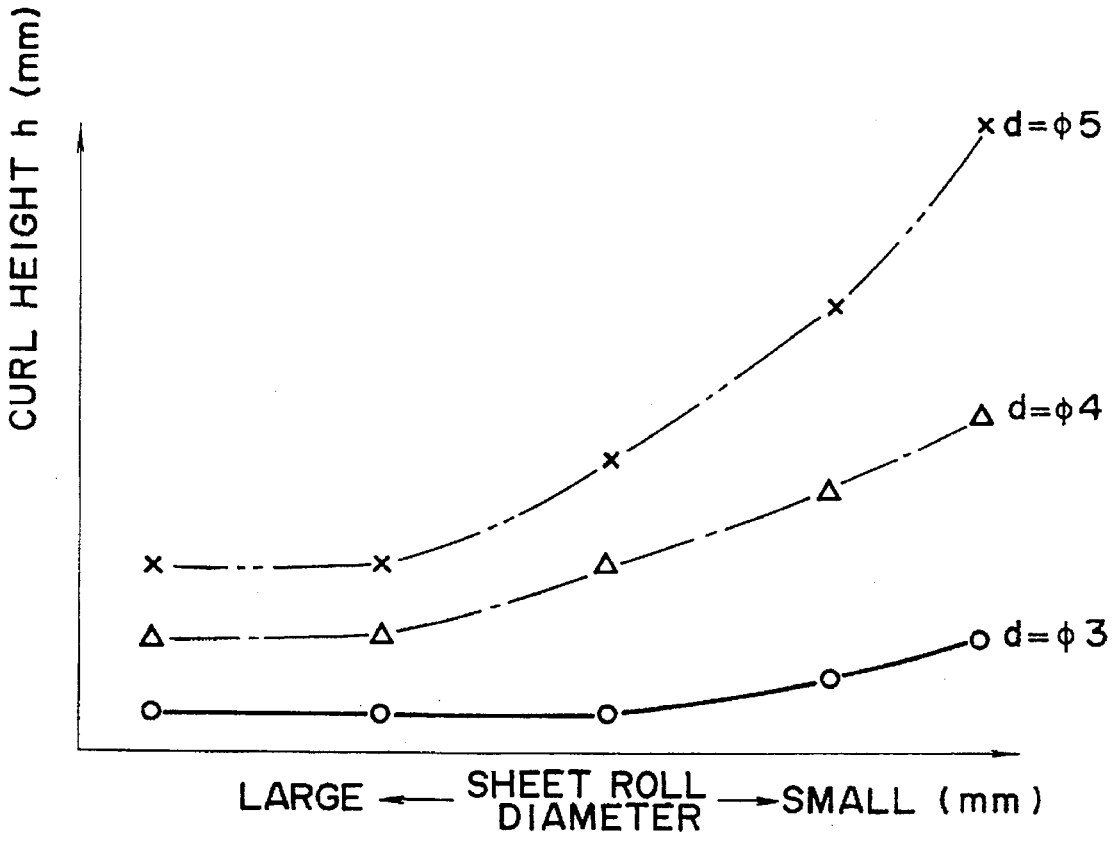
FIG. 28 is a chart showing the relation between the diameter of the curl correcting shaft and the curl correcting effect.
Figure 30:
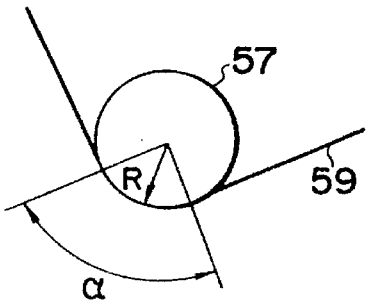
FIG. 30 PRIOR ART
FIGS. 29, 30, 31, 32A, 32B, 33 and 34 are views of prior art devices.
Figure 29:
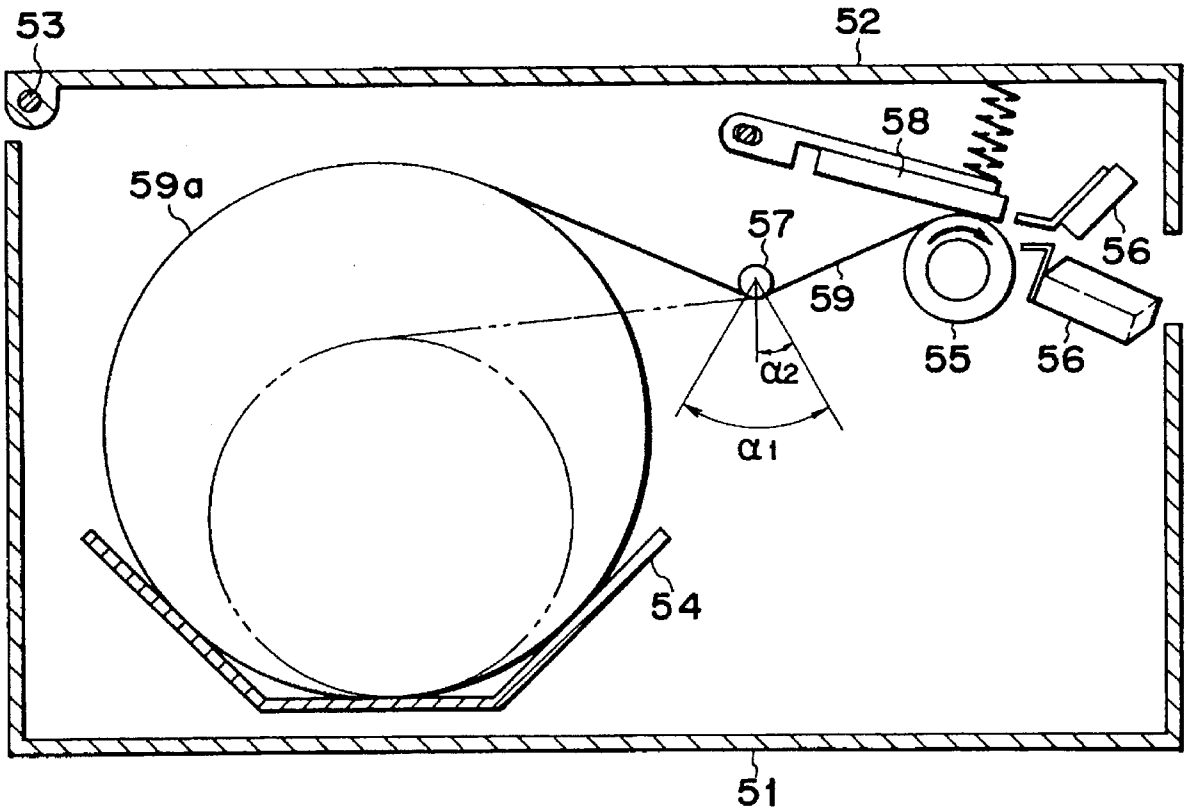
FIG. 29 PRIOR ART
Figure 31:
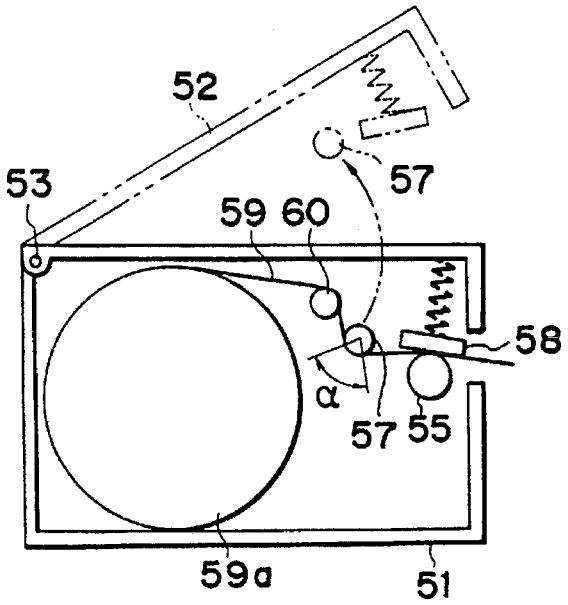
FIG. 31 PRIOR ART
Figure 32A:
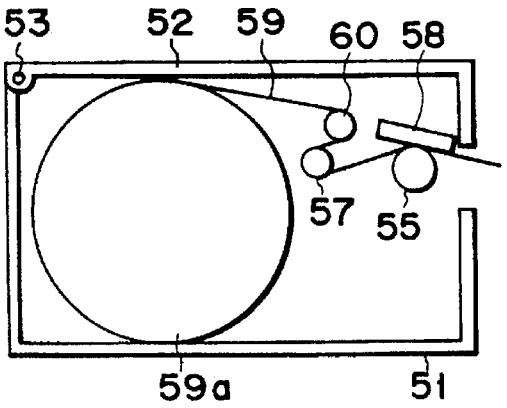
FIG. 32A PRIOR ART
Figure 32B:
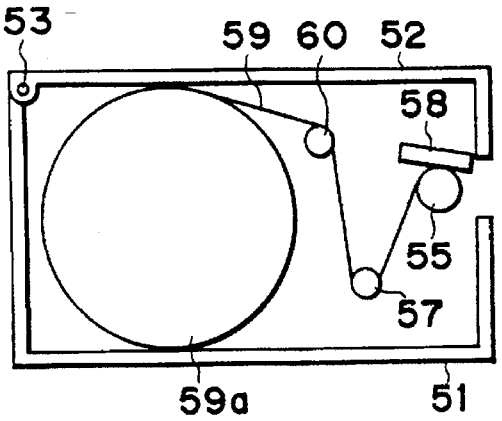
FIG. 32B PRIOR ART
Figure 33:
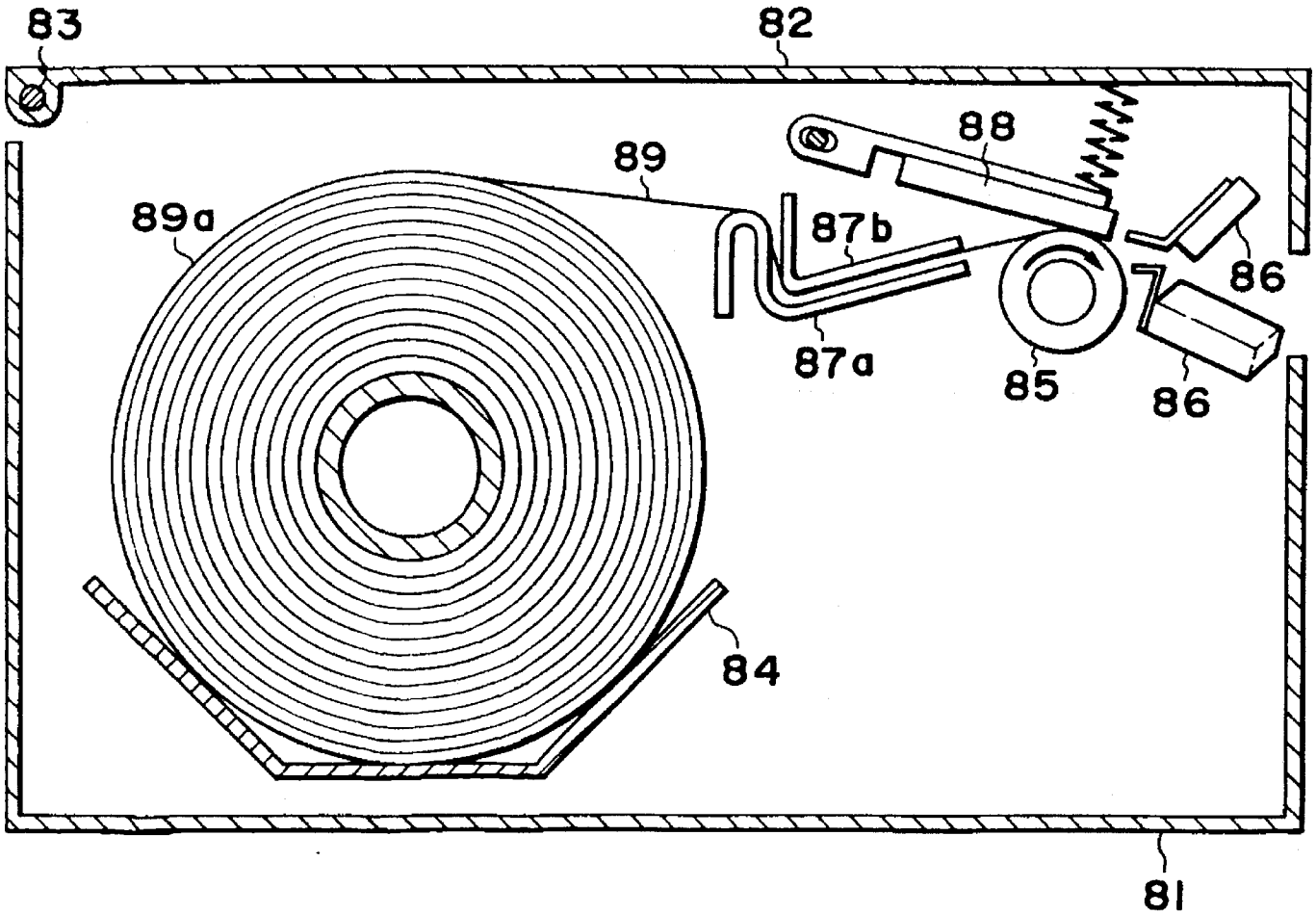
FIG. 33 PRIOR ART
Figure 34:
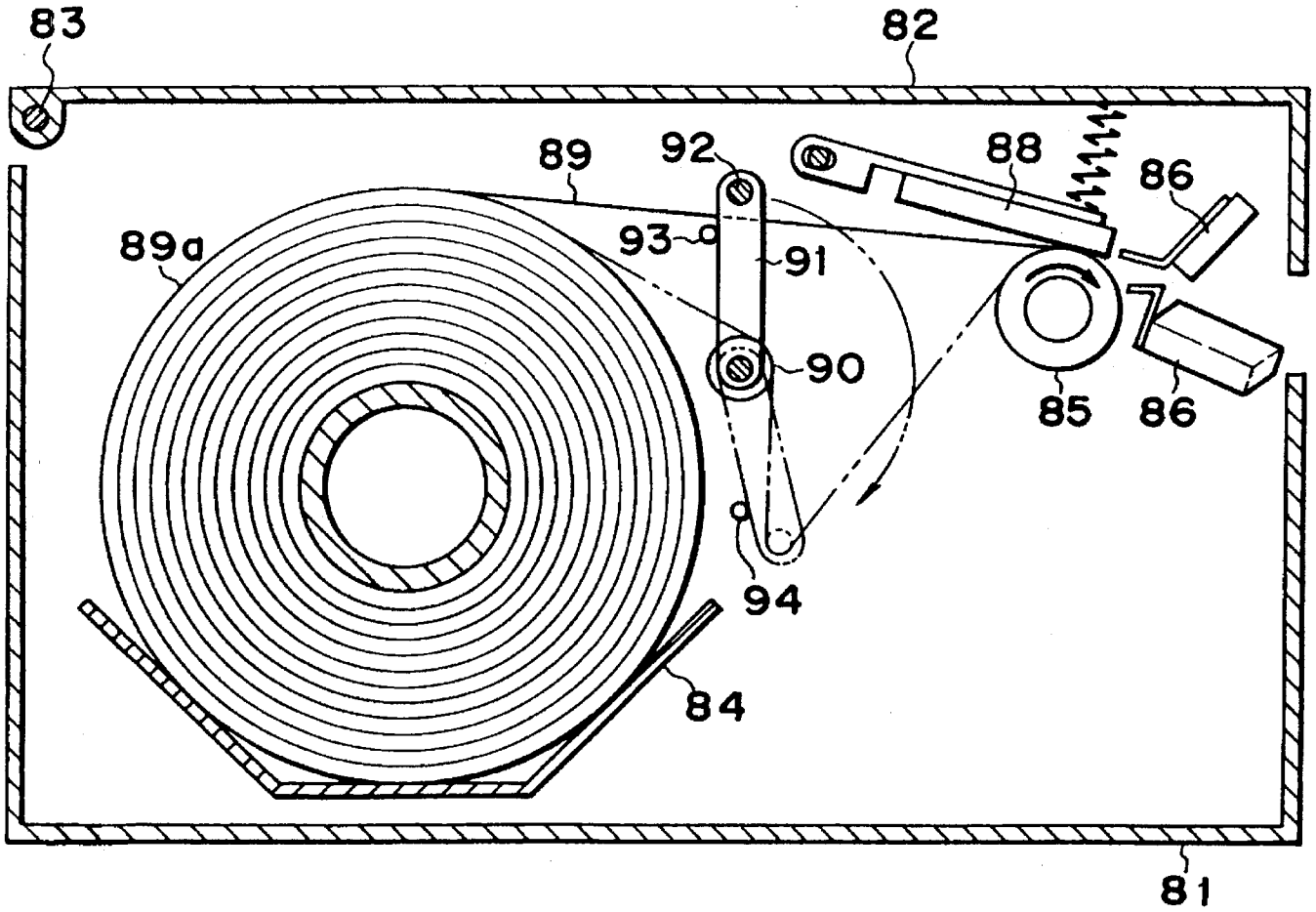
FIG. 34 PRIOR ART

FIG. 28 shows the relation, in the foregoing embodiments, between the curl height h of the sheet 5 and the diameter d of the curl correcting shaft 22, while the diameter of the guide shaft 22 and the angle θ of the sheet 5 are maintained constant.

The curl height h was measured, as shown in FIG. 4A, on the sheet 5 cut into a predetermined length and placed on a horizontal plane. The guide shaft 23 had a constant diameter of 6 mm, while the curl correcting shaft 22 has a diameter d equal to 3, 4 or 5 mm.

FIG. 28 indicates that the curl height h of the sheet 5 is smaller as the roll diameter increases, and vice versa. Also for a same roll diameter, a smaller diameter d of the curl correcting shaft 22 provides a smaller curl height h, thus exhibiting a stronger curl correcting effect.

In the foregoing embodiments, the radius of curvature of the guide shaft 23 is selected to be larger than that of the curl correcting shaft 22, but these radii are not limited to the figures mentioned above. In fact the curl correcting effect can be intensified if the difference of said radii is larger. Also a larger radius of curvature of the guide shaft 23 provides less bending of the sheet 5, thereby enabling stable transportation without creases or skewed feeding.

What is claimed is:

1. A curl correcting device for use with an apparatus having a transport means for transporting a sheet, said device comprising:

a sheet convey path;

a cover openable relative to a main body of said curl correcting device, for opening said sheet convey path;

a first guide member provided on said main body;

a second guide member provided on said cover for correcting a curl of a sheet conveyed along said sheet convey path by cooperating with said first guide member;

lock means for holding, in a hold operation, said cover in a closed position;

lock release means for releasing, in a releasing operation, said hold operation of said lock means and said cover; and position change means for changing a relative position between said first guide member and said second guide member in a direction to weaken the curl correcting operation and to allow opening of said sheet convey path and said cover when said lock release means releases said lock means holding operation out of a state wherein said first and second guide members are in said closed position to correct the curl of the sheet.

2. A device according to claim 1, wherein said sheet convey path is adapted to convey a sheet wound as a roll.

3. A device according to claim 2, wherein said sheet is wound in such a direction that a face of said sheet opposite to said cover is curled inwards.

4. A device according to claim 3, wherein said first guide member is adapted to guide the sheet in contact with a face of the sheet facing said cover.

5. A device according to claim 4, wherein said second guide member is adapted to guide the sheet in contact with a face of the sheet opposite to the face thereof contacting said first guide member.

6. A device according to claim 5, wherein said first guide member has a first guide face of cylindrical shape contacting said sheet.

7. A device according to claim 6, wherein said second guide member has a second guide face of cylindrical shape contacting said sheet.

8. A device according to claim 2, further comprising storage means for storing said rolled sheet.

9. A device according to claim 8, further comprising moving means for moving said first or second guide member according to the diameter of the rolled sheet stored in said storage means.

10. A device according to claim 9, wherein said moving means is adapted to move said first or second guide member in a direction for bending the sheet in a direction opposite to the direction of curl formed in said sheet, as the diameter of the rolled sheet stored in said storage means decreases.

11. A device according to claim 10, wherein said moving means comprises biasing means for biasing said first or second guide member in a direction for bending the sheet in a direction opposite to the direction of curl formed in said sheet, as the diameter of the rolled sheet stored in said storage means decreases.

12. A device according to claim 1, wherein said position change means is adapted to move said first or second guide member to a position which does not hinder opening of said guide member, in linkage with the releasing operation of said lock release means.

13. A device according to claim 1, further comprising drive means for driving said moving means to move said first or second guide member.

14. A curl correcting device according to claim 1, further comprising record means for recording an image on the sheet passing through said sheet convey path.

15. A curl correcting device according to claim 14, further comprising moving means for moving said first or second guide member in a direction to weaken the curl correcting operation, after said recording means has finished recording.

16. A curl correcting device for use with an apparatus having transport means for transporting a sheet, said device comprising:

a sheet convey path;

a cover openable relative to a main body of said curl correcting device, for opening said sheet convey path;

curl correct means for correcting a curl of the sheet conveyed along said convey path;

lock means for holding, in a hold operation, said cover in a closed position;

lock release means for releasing, in a releasing operation, said hold operation of said lock means and said cover; and curl correct release means for weakening a curl correction operation of said curl correct means and for allowing opening of said sheet convey path and said cover when said lock release means causes said release operation of said hold operation out of a state wherein said curl correct means corrects the curl.

17. A curl correcting device for use with an apparatus having transport means for transporting a sheet, said device comprising:

a sheet convey path;

a cover openable relative to a main body of said curl correcting device, for opening said sheet convey path;

a first guide member provided on said main body;

a second guide member provided on said cover for correcting a curl of a sheet conveyed along said sheet convey path by cooperating with said first guide member;

lock means for holding, in a hold operation, said cover in a closed position;

lock release means for releasing, in a releasing operation, said hold operation of said lock means and said cover; and position change means for shifting at least one of said first and second guide members in a direction to weaken the curl correcting operation and to allow opening of said sheet convey path and said cover when said lock release means causes said release operation of said open member hold operation out of a state wherein said first and second guide members are in said closed position to correct the curl of the sheet.

18. A curl correcting device according to claim 17, wherein said sheet convey path is adapted to convey the sheet wound as a roll.

19. A curl correcting device according to claim 18, wherein the sheet is wound in such a direction that a face of the sheet opposite to said open member is curled inwardly.

20. A curl correcting device according to claim 19, wherein said first guide member is adapted to guide the sheet in contact with a face of the sheet opposite to said open member.

21. A curl correcting device according to claim 20, wherein said second guide member is adapted to guide the sheet in contact with a face of the sheet opposite to the face thereof contacting said first guide member.

22. A curl correcting device according to claim 21, wherein said first guide member has a first guide face of cylindrical shape contacting said sheet.

23. A curl correcting device according to claim 22 wherein said second guide member has a second guide face of cylindrical shape contacting said sheet.

24. A curl correcting device according to claim 18 further comprising storage means for storing said rolled sheet.

25. A curl correcting device according to claim 24, further comprising shift means for shifting said first and said second guide members, according to a diameter of the rolled sheet stored in said storage means.

26. A curl correcting device according to claim 25, wherein said shift means moves said first or said second guide member in a direction for bending the sheet in a direction opposite to the direction of the curl formed in said sheet, as the diameter of the rolled sheet stored in said storage means decreases.

27. A curl correcting device according to claim 26, wherein said shift means comprises biasing means for biasing said first or said second guide member in the direction for bending the sheet in the direction opposite to the direction of curl formed in said sheet, as the diameter of the rolled sheet stored in said storage means decreases.

28. A curl correcting device according to claim 17, wherein said position change means moves said first or said second guide member to a position such that said curl is not corrected when said lock release means releases said lock means.

29. A curl correcting device according to claim 25, further comprising drive means for driving said shift means to move said first or said second guide member.

30. A curl correcting device according to claim 17, further comprising image recording means for recording an image on the sheet passing through said sheet convey path.

31. A curl correcting device according to claim 30, further comprising moving means for moving at least one of said first and said second guide members in a direction to weaken the curl correcting operation, after said recording means has finished the recording.

32. A curl correcting device according to claim 30, wherein said image recording means records an image according to a received image signal.

33. A curl correcting device according to claim 32, further comprising moving means for moving at least one of said first and said second guide members in a direction to weaken the curl correcting operation, after the recording according to the received image signal.

34. A curl correcting device according to claim 31, further comprising drive means for driving said moving means to move said first or said second guide member to a position in which the curl is not corrected.

35. A curl correcting device according to claim 34, wherein said drive means drives said moving means to move said first or said second guide member to a position in which the curl is not corrected, after image recording of a segment of said sheet by said image recording means, where each said segment, after image recording, is cut from said sheet by a cutting means for cutting.

36. A curl correcting device according to claim 34, wherein said image recording means records an image according to a received image signal.

37. A curl correcting device according to claim 36, wherein said drive means drives said moving means, after an image corresponding to the received image signal has been recorded, to move said first or said second guide member to a position in which said curl is not corrected.

38. A curl correcting device, comprising:

a sheet transport path;

transport means for transporting a sheet along said sheet transport path, said sheet having been wound on a sheet roll, said sheet roll having a diameter;

first guide means for guiding the sheet transported by said transport means;

second guide means for guiding the sheet transported by said transport means, said second guide means cooperating with said first guide means to correct a curl of the sheet;

urging means for urging at least one of said first and said second guide means in a direction such that the sheet is bent in a direction reverse to the curl of the sheet, as said diameter of said sheet roll decreases, said urging means having an urging force; and changing means for changing the urging force of said urging means.

39. A curl correcting device according to claim 38, wherein said transport means transports the sheet wound on the sheet roll.

40. A curl correcting device according to claim 39, wherein the sheet is wound around the roll in a direction where a surface opposite to said transport means curls inwardly.

41. A curl correcting device according to claim 33, wherein said second guide means guides the sheet by contacting with a surface of the sheet which is opposite to a sheet surface which said first guide means contacts.

42. A curl correcting device according to claim 38, wherein said first guide means comprises a first cylindrical guide surface contacting the sheet.

43. A curl correcting device according to claim 42, wherein said second guide means further comprises a second cylindrical guide surface contacting the sheet.

44. A curl correcting device according to claim 39, further comprising container means for containing the sheet roll.

45. A curl correcting device according to claim 39, wherein said urging means urges and thereby moves at least one of said first and said second guide means corresponding to the diameter of the sheet roll contained in said container means.

46. A curl correcting device according to claim 45, wherein said urging means urges and thereby moves at least one of said first and said second guide means in a direction where the sheet is bent in a direction reverse to the curl formed on the sheet, as the diameter of the sheet roll decreases.

47. A curl correcting device according to claim 38, further comprising a cover openable from said main body for releasing said sheet transport path.

48. A curl correcting device according to claim 47, further comprising locking means for locking said cover in a closed state, and release means for releasing the locking means so that said cover is not in said closed state.

49. A curl correcting device according to claim 48, further comprising moving means for moving said first or second guide means to a position where it does not correct the curl, corresponding to a releasing operation of said releasing means.

50. A curl correcting device according to claim 49, further comprising driving means for driving said moving means to move thereby at least one of said first and said second guide means.

51. A curl correcting device according to claim 38, wherein said urging means comprises a spring, an end of which is connected to one of said first and said second guide means, and another end of which is connected to a main body of said device.

52. A curl correcting device according to claim 51, wherein said changing means changes the urging force by changing a connecting point of said spring with said main body.

53. A curl correcting device according to claim 52, wherein said changing means comprises an actuator.

54. A curl correcting device according to claim 38, further comprising record means for recording an image on the sheet passing through said sheet convey path.

* * * * *

UNITED STATES PATENT AND TRADEMARK OFFICE

CERTIFICATE OF CORRECTION

PATENT NO. : 5,637,070

DATED : June 10, 1997

INVENTOR(S) : Keizo Sasai

It is certified that error appears in the above-identified patent and that said Letters Patent is hereby corrected as shown below:

ON TITLE PAGE, ITEM [56], REFERENCES CITED, FOREIGN PATENT DOCUMENTS

"62-175377 8/1977 Japan" should be deleted (duplicated with correct date on inside cover).

COLUMN 1

Line 24, "in" should be deleted;

Line 61, "member" should read --member 52.--

COLUMN 4

Line 5, "said" should read --this--.

COLUMN 5

Line 40, "said" should read --the--.

COLUMN 14

Line 27, "is" should read --are--.

COLUMN 19

Line 6, "returns" should read --return--.

COLUMN 20

Line 52, "rotates" should read --rotate--.

COLUMN 22

Line 9, "control" should read --controls--.

COLUMN 23

Line 46, "program." should read --the program.--

UNITED STATES PATENT AND TRADEMARK OFFICE

CERTIFICATE OF CORRECTION

PATENT NO. : 5,637,070

DATED : June 10, 1997

INVENTOR(S) : Keizo Sasai

It is certified that error appears in the above-identified patent and that said Letters Patent is hereby corrected as shown below:

COLUMN 26

Line 48, "open member" should read --cover--;
Line 51, "open" should read --cover.--;
Line 52, "member." should be deleted.
Line 59, "claim 22" should read --claim 22,--;
Line 62, "claim 18" should read --claim 18,--.

COLUMN 28

Line 13, "claim 33," should read --claim 38,--.

Signed and Sealed this

Tenth Day of February, 1998

*Attest:*

*Attesting Officer*

BRUCE LEHMAN

*Commissioner of Patents and Trademarks*